US008627890B2

(12) United States Patent
Bailey et al.

(10) Patent No.: US 8,627,890 B2
(45) Date of Patent: Jan. 14, 2014

(54) ROTATING CONTINUOUS FLOW SUB

(75) Inventors: Thomas F. Bailey, Houston, TX (US); Mark A. Mitchell, Pearland, TX (US); David Pavel, Kingwood, TX (US); Lev Ring, Houston, TX (US); Ram K. Bansal, Houston, TX (US); David Iblings, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 355 days.

(21) Appl. No.: 12/984,429

(22) Filed: Jan. 4, 2011

(65) Prior Publication Data

US 2011/0155379 A1 Jun. 30, 2011

Related U.S. Application Data

(63) Continuation-in-part of application No. 12/180,121, filed on Jul. 25, 2008, now Pat. No. 8,016,033.

(60) Provisional application No. 61/292,607, filed on Jan. 6, 2010, provisional application No. 60/952,539, filed on Jul. 27, 2007, provisional application No. 60/973,434, filed on Sep. 18, 2007.

(51) Int. Cl.
*E21B 21/02* (2006.01)
*E21B 34/00* (2006.01)

(52) U.S. Cl.
USPC ..... 166/332.1; 166/319; 166/95.1; 166/77.1; 175/218

(58) Field of Classification Search
USPC ..... 166/319, 321, 332.1, 332.3, 334.1, 166/334.4, 334.2, 77.1, 77.51, 85.1, 95.1; 175/218
See application file for complete search history.

(56) References Cited

U.S. PATENT DOCUMENTS

| | | | | |
|---|---|---|---|---|
| 2,158,356 | A | 5/1939 | Dyer | |
| 2,849,213 | A * | 8/1958 | Failing | 175/213 |
| 3,559,739 | A * | 2/1971 | Hutchison | 166/311 |
| 3,750,749 | A * | 8/1973 | Giroux | 166/95.1 |
| 4,315,553 | A | 2/1982 | Stallings | |
| 4,423,774 | A * | 1/1984 | Mefford | 166/77.51 |
| 4,854,383 | A * | 8/1989 | Arnold et al. | 166/70 |
| 5,996,712 | A | 12/1999 | Boyd | |
| 6,230,824 | B1 | 5/2001 | Peterman et al. | |
| 6,315,051 | B1 | 11/2001 | Ayling | |
| 6,378,630 | B1 | 4/2002 | Ritorto et al. | |
| 6,382,333 | B1 | 5/2002 | Murray | |
| 6,412,554 | B1 * | 7/2002 | Allen et al. | 166/80.1 |
| 6,581,692 | B1 * | 6/2003 | Koch et al. | 166/380 |

(Continued)

FOREIGN PATENT DOCUMENTS

EP 1898044 A2 3/2008

OTHER PUBLICATIONS

International Search Report and Written Opinion dated Jan. 19, 2012, International Application No. PCT/US2011/020261.

*Primary Examiner* — Kenneth L Thompson
(74) *Attorney, Agent, or Firm* — Patterson & Sheridan, L.L.P.

(57) ABSTRACT

A method for drilling a wellbore includes drilling the wellbore by advancing the tubular string longitudinally into the wellbore; stopping drilling by holding the tubular string longitudinally stationary; adding a tubular joint or stand of joints to the tubular string while injecting drilling fluid into a side port of the tubular string, rotating the tubular string, and holding the tubular string longitudinally stationary; and resuming drilling of the wellbore after adding the joint or stand.

22 Claims, 20 Drawing Sheets

(56) References Cited

U.S. PATENT DOCUMENTS

| | | | | |
|---|---|---|---|---|
| 6,585,043 | B1 | 7/2003 | Murray | |
| 6,779,599 | B2 * | 8/2004 | Mullins et al. | 166/90.1 |
| 6,915,865 | B2 | 7/2005 | Boyd | |
| 6,994,628 | B2 | 2/2006 | Boyd | |
| 7,011,162 | B2 | 3/2006 | Maguire | |
| 7,107,875 | B2 | 9/2006 | Haugen et al. | |
| 7,163,064 | B2 * | 1/2007 | Moncus et al. | 166/379 |
| RE41,759 | E | 9/2010 | Helms | |
| 7,836,973 | B2 | 11/2010 | Belcher et al. | |
| 2002/0129976 | A1 | 9/2002 | Rastegar | |
| 2003/0127857 | A1 | 7/2003 | Boyd et al. | |
| 2006/0254822 | A1 * | 11/2006 | Ayling | 175/57 |
| 2006/0289154 | A1 * | 12/2006 | Robichaux et al. | 166/85.1 |

* cited by examiner

FIG. 1A
(PRIOR ART)
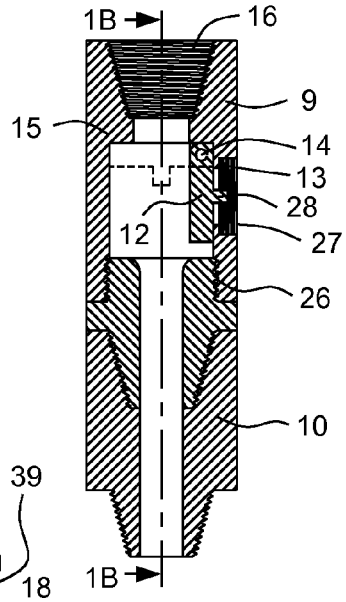
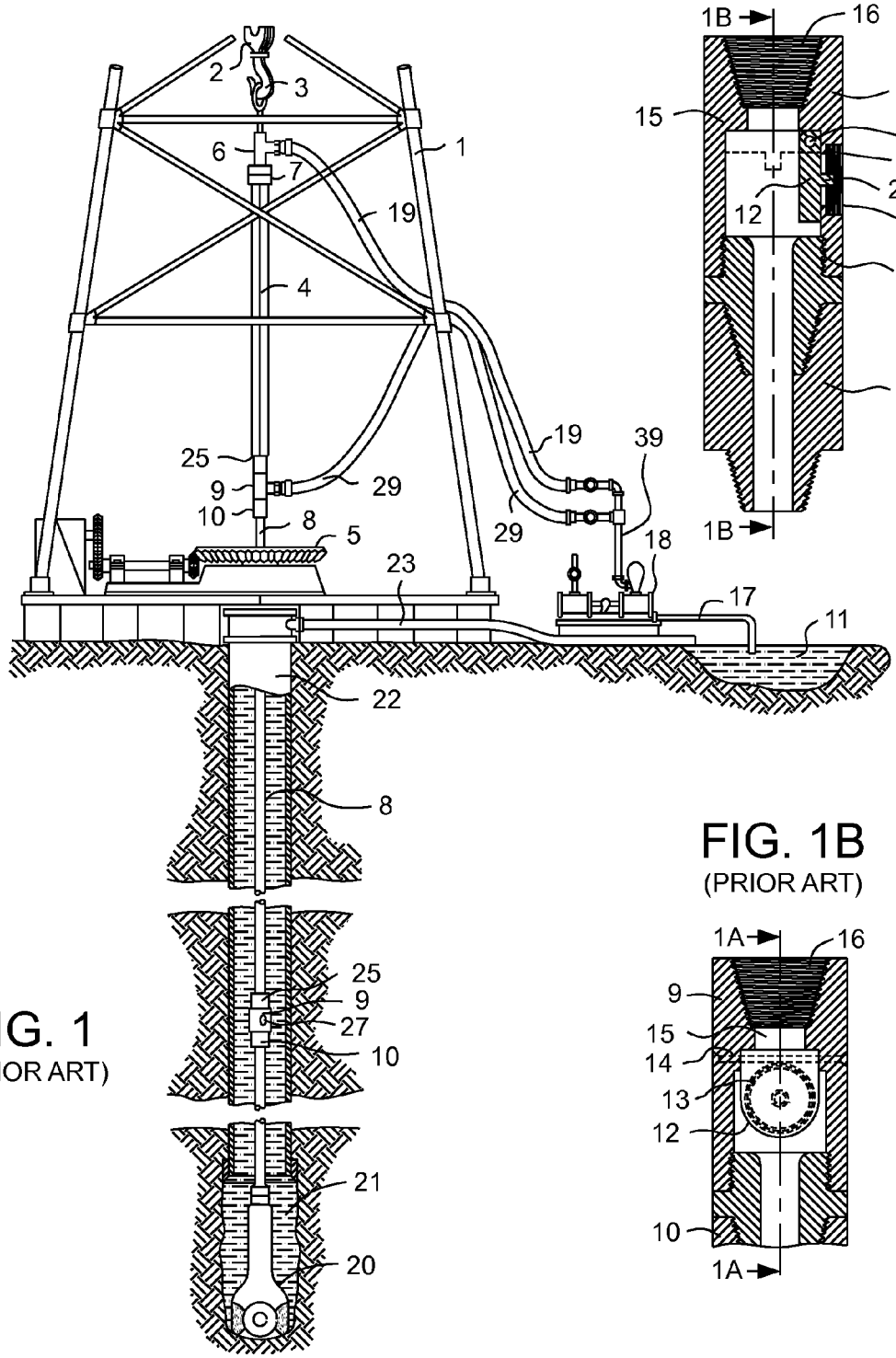
FIG. 1
(PRIOR ART)
FIG. 1B
(PRIOR ART)

| Step | Operation | 171a | 171b | 171c | 156i | 156o |
|---|---|---|---|---|---|---|
| 1 | Connect Clamp | Closed | Closed | Closed | Closed | Closed |
| 2 | Bleed Air | Open | Closed | Closed | Open | Open |
| 3 | Open Port Valve & Add Stand | Closed | Open | Closed | Open | Closed |
| 4 | Close Port Valve | Closed | Closed | Open | Closed | Open |
| 5 | Remove Clamp | Closed | Closed | Closed | Closed | Closed |

ROTATING CONTINUOUS FLOW SUB

CROSS-REFERENCE TO RELATED APPLICATIONS

This application claims the benefit of U.S. Prov. Pat. App. No. 61/292,607 hereinafter '607 provisional application), filed on Jan. 6, 2010, which is herein incorporated by reference in its entirety.

This application is also a continuation-in-part of U.S. patent application Ser. No. 12/180,121 filed Jul. 25, 2008 now U.S. Pat. No. 8,016,033, which claims the benefit of U.S. Prov. Pat. App. No. 60/952,539 filed on Jul. 27, 2007, and U.S. Prov. Pat. App. No. 60/973,434 filed on Sep. 18, 2007, all of which are herein incorporated by reference in their entireties.

BACKGROUND OF THE INVENTION

1. Field of the Invention

The present invention relates to a rotating continuous flow sub.

2. Description of the Related Art

In many drilling operations in drilling in the earth to recover hydrocarbons, a drill string made by assembling pieces or joints of drill tubulars or pipe with threaded connections and having a drill bit at the bottom is rotated to move the drill bit. Typically drilling fluid, such as oil or water based mud, is circulated to and through the drill bit to lubricate and cool the bit and to facilitate the removal of cuttings from the wellbore that is being formed. The drilling fluid and cuttings returns to the surface via an annulus formed between the drill string and the wellbore. At the surface, the cuttings are removed from the drilling fluid and the drilling fluid is recycled.

As the drill bit penetrates into the earth and the wellbore is lengthened, more joints of drill pipe are added to the drill string. This involves stopping the drilling while the tubulars are added. The process is reversed when the drill string is removed or tripped, e.g. to replace the drilling bit or to perform other wellbore operations. Interruption of drilling may mean that the circulation of the mud stops and has to be re-started when drilling resumes. This can be time consuming, can cause deleterious effects on the walls of the wellbore being drilled, and can lead to formation damage and problems in maintaining an open wellbore. Also, a particular mud weight may be chosen to provide a static head relating to the ambient pressure at the top of a drill string when it is open while tubulars are being added or removed. The weighting of the mud can be very expensive.

To convey drilled cuttings away from a drill bit and up and out of a wellbore being drilled, the cuttings are maintained in suspension in the drilling fluid. If the flow of fluid with cuttings suspended in it ceases, the cuttings tend to fall within the fluid. This is inhibited by using relatively viscous drilling fluid; but thicker fluids require more power to pump. Further, restarting fluid circulation following a cessation of circulation may result in the overpressuring of a formation in which the wellbore is being formed.

FIG. 1 is a prior art diagrammatic view of a portion of a continuous flow system. FIG. 1A is a sectional elevation of a portion of the union used to connect two sections of drill pipe, showing a short nipple to which is secured a valve assembly. FIG. 1B is a sectional view taken along the line 1B-1B of FIG. 1A.

A derrick 1 supports long sections of drill pipe 8 to be lowered and raised through a tackle having a lower block 2 supporting a swivel hook 3. The upper section of the drill string includes a tube or Kelly 4, square or hexagonal in cross section. The Kelly 4 is adapted to be lowered through a square or hexagonal hole in a rotary table 5 so, when the rotary table is rotated, the Kelly will be rotated. To the upper end of the Kelly 4 is secured a connection 6 by a swivel joint 7. The drill pipe 8 is connected to the Kelly 4 by an assembly which includes a short nipple 10 which is secured to the upper end of the drill pipe 8, a valve assembly 9, and a short nipple 25 which is directly connected to the Kelly 4. A similar short nipple 25 is connected to the lower end of each section of the drill pipe.

Each valve assembly 9 is provided with a valve 12, such as a flapper, and a threaded opening 13. The flapper 12 is hinged to rotate around the pivot 14. The flapper 12 is biased to cover the opening 13 but may pivot to the dotted line position of FIG. 1A to cover opening 15 which communicates with the drill pipe or Kelly through short a nipple 25 into the screw threads 16. The flapper 12 pivots to cover opening 15 in response to switching of circulation from hose 19 to hose 29. The flapper 12 is provided with a screw threaded extension 28 which is adapted to project into the threaded opening 13. A plug member 27 is adapted to be screwed on extension 28 as shown in FIG. 1A, normally holding the valve 12 in the position covering the side opening in the valve assembly. Normally, before drilling commences, lengths of drill pipe are assembled in the vicinity of the drill hole to form "stands" of drill pipe. Each stand may include two or more joints of pipe, depending upon the height of the derrick, length of the Kelly, type of drilling, and the like. The sections of the stand are joined to one another by a threaded connection, which may include nipples 25 and 10, screwed into each other. At the top of each stand, a valve assembly 9 is placed. It will be observed that the valve body acts as a connecting medium or union between the Kelly and the drill string.

Normally, oil well fluid circulation is maintained by pumping drilling fluid from the sump 11 through pipe 17 through which the pump 18 takes suction. The pump 18 discharges through a header 39 into valve controlled flexible conduit 19 which is normally connected to the member 6 at the top of the Kelly, as shown in FIG. 1. The mud passes down through the drill pipe assembly out through the openings in the drill bit 20, into the wellbore 21 where it flows upwardly through the annulus and is taken out of the well casing 22 through a pipe 23 and is discharged into the sump 11. The Kelly 4, during drilling, is being operated by the rotary table 5. When the drilling has progressed to such an extent that is necessary to add a new stand of drill pipe, the tackle is operated to lift the drill string so that the last section of the drill pipe and the union assembly composed of short nipple 25, valve assembly 9, and short nipple 10 are above the rotary table. The drill string is then supported by engaging a slips (not shown).

The plug 27 is unscrewed from the valve body and a hose 29, which is controlled by a suitable valve, is screwed into the screw threaded opening 13. While this operation takes place, the circulation is being maintained through hose 19. When connection is made, the valve controlling hose 29 is opened and momentarily mud is being supplied through both hoses 19 and 29. The valve controlling hose 19 is then closed and circulation takes place as before through hose 29. The Kelly is then disconnected and a new stand is joined to the top of the valve body, connected by screw threads 16. After the additional stand has been connected, the valve controlling hose 19 is again opened and momentarily mud is being circulated through both hoses 19 and 29. Then the valve controlling hose 29 is closed, which permits the valve 12 to again cover opening 13. The hose 29 is then disconnected and the plug 27 is replaced.

SUMMARY OF THE INVENTION

In one embodiment, a method for drilling a wellbore includes drilling the wellbore by advancing the tubular string longitudinally into the wellbore; stopping drilling by holding the tubular string longitudinally stationary; adding a tubular joint or stand of joints to the tubular string while injecting drilling fluid into a side port of the tubular string, rotating the tubular string, and holding the tubular string longitudinally stationary; and resuming drilling of the wellbore after adding the joint or stand.

In another embodiment, a method for drilling a wellbore, includes a) while injecting drilling fluid into a top of a tubular string disposed in the wellbore and having a drill bit disposed on a bottom thereof and rotating the tubular string: drilling the wellbore by advancing the tubular string longitudinally into the wellbore; and stopping drilling by holding the tubular string longitudinally stationary; b) injecting drilling fluid into a side port of the tubular string while injecting drilling fluid into the top, rotating the tubular string, and holding the tubular string longitudinally stationary; c) while injecting drilling fluid into the port, rotating the tubular string, and holding the tubular string longitudinally stationary: stopping injection of drilling fluid into the top; adding a tubular joint or stand of joints to the tubular string; and injecting drilling fluid into the top; and d) stopping injection of drilling fluid into the port while injecting drilling fluid into the top, rotating the tubular string, and holding the tubular string longitudinally stationary.

In another embodiment, method for drilling a wellbore, includes drilling the wellbore by rotating a tubular string using a top drive and advancing the tubular string longitudinally into the wellbore; rotationally unlocking an upper portion of the tubular string having a side port from a rest of the tubular string; adding a tubular joint or stand of joints to the upper portion while injecting drilling fluid into the side port and rotating the rest of the tubular string using a rotary table; rotationally locking the upper portion to the rest of the tubular string after adding the joint or stand; and resuming drilling of the wellbore after rotationally locking the upper portion.

In another embodiment, a continuous flow sub (CFS) for use with a drill string, includes a tubular housing having a central longitudinal bore therethrough and a port formed through a wall thereof and in fluid communication with the bore; a sleeve or case disposed along an outer surface of the housing, the sleeve or case having a port formed through a wall thereof; one or more bearings disposed between the housing and the sleeve/case, the bearings supporting rotation of the housing relative to the sleeve/case; one or more seals disposed between the housing and the sleeve/case and providing a sealed fluid path between the sleeve/case port and the housing port; and a closure member operable to prevent fluid flow through the fluid path.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1 is a diagrammatic view of a prior art continuous flow system. FIG. 1A is a sectional elevation of a portion of the union used to connect two sections of drill pipe, showing a short nipple to which is secured a valve assembly. FIG. 1B is a sectional view taken along the line 1B-1B of FIG. 1A.

DETAILED DESCRIPTION

Figure 2:
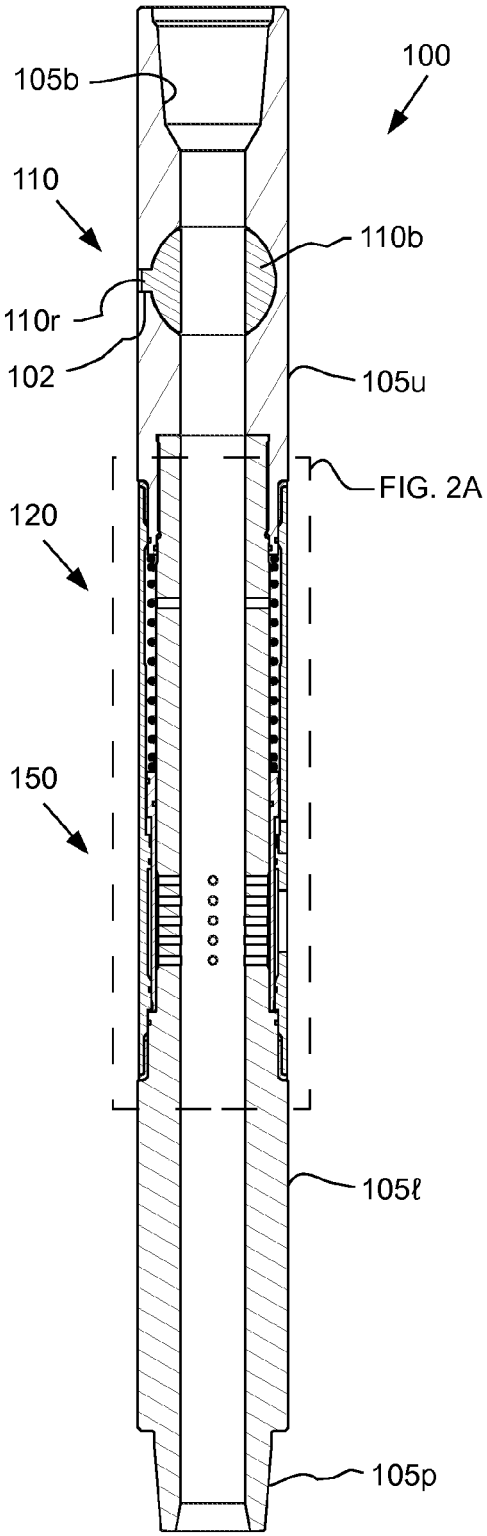
FIG. 2 is a cross-sectional view of a rotating continuous flow sub (RCFS) in a top injection mode, according to one embodiment of the present invention.
Figure 2A:
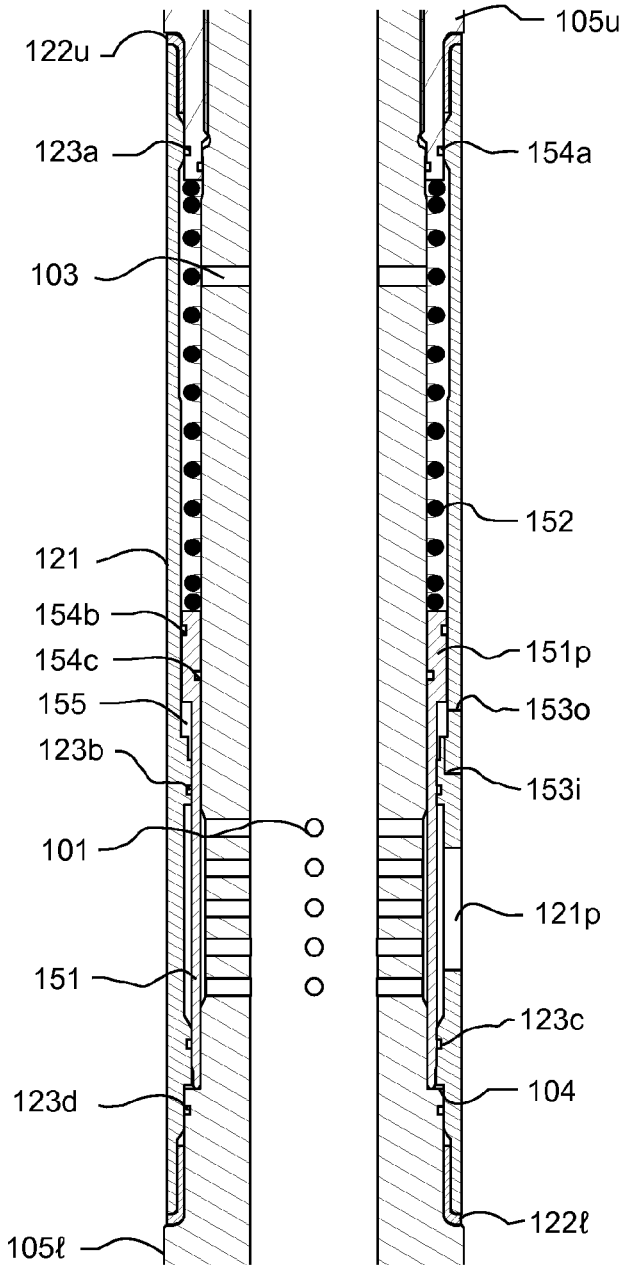
FIG. 2A is an enlargement of a portion of the RCFS.
Figure 3:
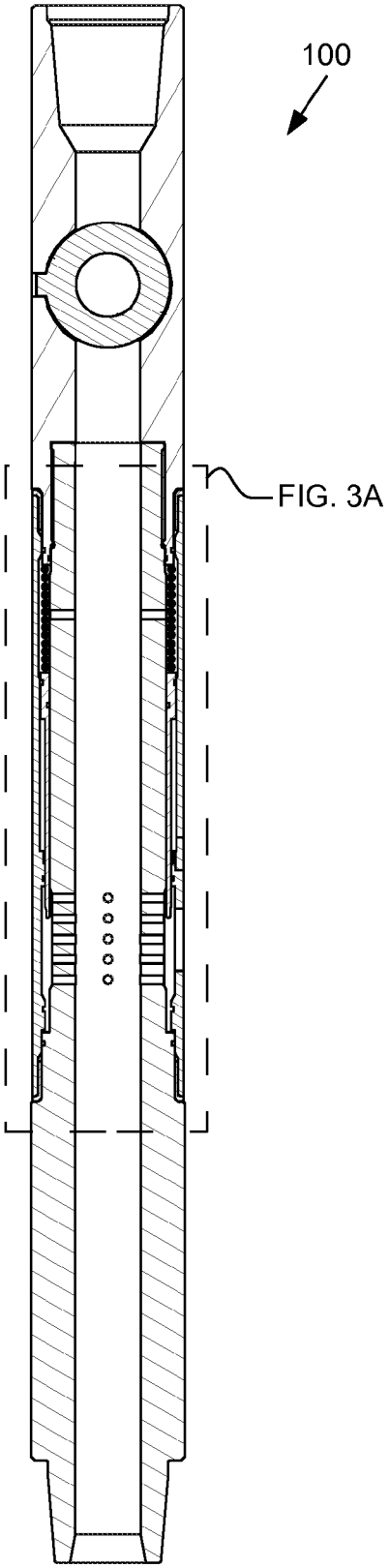
FIG. 3 is a cross-sectional view of the RCFS in a side injection mode.
Figure 3A:
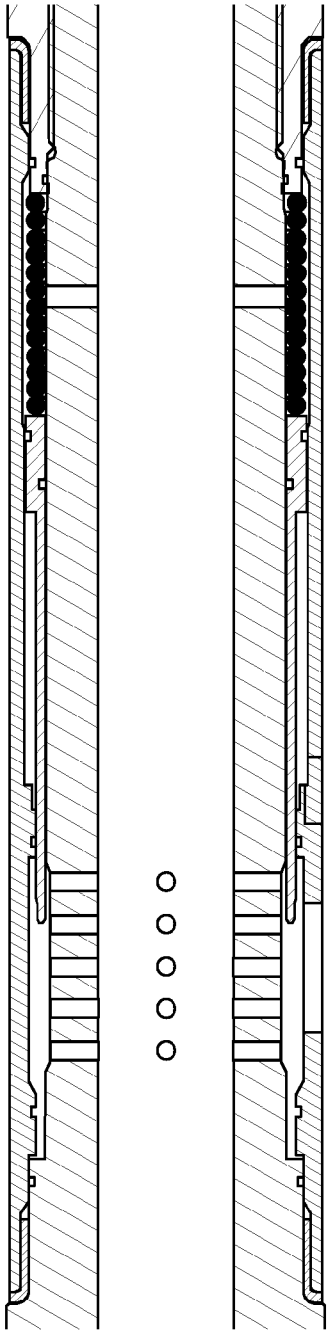
FIG. 3A is an enlargement of a portion of the RCFS.

FIG. 2 is a cross-sectional view of a rotating continuous flow sub (RCFS) 100 in a top injection mode, according to one embodiment of the present invention. FIG. 2A is an enlargement of a portion of the RCFS 100. FIG. 3 is a cross-sectional view of the RCFS 100 in a side injection mode. FIG. 3A is an enlargement of a portion of the RCFS 100.

The RCFS 100 may include a tubular housing 105*u,l*, a bore valve 110, a swivel 120, and a side port valve 150. The tubular housing 105*u,l*, may include one or more sections, such as an upper section 105*u* and a lower 105*l* section, each section connected together, such as by fastening with a threaded connection. The tubular housing 105*u,l* may have a central longitudinal bore therethrough and one or more radial flow ports 101 formed through a wall thereof in fluid communication with the bore. The flow ports 101 may be spaced circumferentially around the housing and each of the ports may be formed as a longitudinal series of small ports to improve structural integrity. The housing 105*u,l* may also have a threaded coupling at each longitudinal end, such as box 105*b* formed in an upper longitudinal end and a threaded pin 105*p* formed on a lower longitudinal end, so that the housing may be assembled as part of the drill string. Except where otherwise specified, the RCFS 100 may be made from a metal or alloy, such as steel or stainless steel.

A length of the housing 105*u,l*, may be equal to or less than the length of a standard joint of drill pipe 8. Additionally, the housing 105*u,l*, may be provided with one or more pup joints (not shown) in order to provide for a total assembly length equivalent to that of a standard joint of drill pipe. The pup joints may include one or more stabilizers or centralizers or the stabilizers or centralizers may be mounted on the housing.

Additionally, the housing 105*u,l*, may further include one or more external stabilizers or centralizers (not shown). Such stabilizers or centralizers may be mounted directly on an outer surface of the housing &/or proximate the housing above and/or below it (as separate housings). The stabilizers or centralizers may be of rigid construction or of yielding, flexible, or sprung construction. The stabilizers or centralizers may be constructed from any suitable material or combination of materials, such as metal or alloy, or a polymer, such as an elastomer, such as rubber. The stabilizers or centralizers may be molded or mounted in such a way that rotation of the sub about its longitudinal axis also rotates the stabilizers or centralizers. Alternatively, the stabilizers or centralizers may be mounted such that at least a portion of the stabilizers or centralizers may be able to rotate independently of the housing.

The bore valve 110 may include a closure member, such as a ball 110*b*, and a seat (not shown). The seat may be made from a metal/alloy, ceramic/cermet, or polymer and may be connected to the housing, such as by fastening. The ball 110*b* may be disposed in a spherical recess formed in the housing and rotatable relative thereto. The ball 110*b* operable between an open position (FIG. 2) and a closed position (FIG. 3). The ball 110*b* may have a bore therethrough corresponding to the housing bore and aligned therewith in the open position. A wall of the ball may close the bore in the closed position. The ball may have a receiver 110*r* extending into an actuation port 102 formed radially through a wall of the housing. The receiver 110*r* may receive a stem (not shown) of an external actuator (not shown) operable to rotate the ball 110*b* between the open and the closed positions. The actuator may be manual, hydraulic, pneumatic, or electric.

Alternatively, the bore valve 110 may be replaced by a float valve, such as a flapper (FIG. 7A) or poppet valve.

The swivel 120 may include a sleeve 121, one or more bearings, such as an upper bearing 122*u* and a lower bearing 122*l*, and one or more seals 123*a-d*. The sleeve 121 may be disposed between the upper 105*u* and lower 105*l* housing sections, thereby longitudinally coupling the sleeve to the housing. The sleeve 121 may have a radial port 121*p* formed through a wall thereof and the port may be aligned with the housing ports 101. The bearings 122*u,l* may be disposed between respective ends of the sleeve 121 and a respective housing section 105*u,l*, thereby facilitating rotation of the housing relative to the sleeve. The bearings 122*u,l* may be radial bearings, such as rolling element or hydrodynamic bearings. The seals 123*a-d* may each be a seal stack of polymer seal rings or rotating seals, such as mechanical face seals, labyrinth seals, or controlled gap seals.

The port valve 150 may include a closure member, such as a sleeve 151, an actuator, and one or more seals 154*a-d*. The valve sleeve 151 may be disposed in an annulus radially formed between the swivel sleeve 121 and the lower housing section 105*l*. The valve sleeve 151 may be free to rotate relative to both the swivel sleeve 121 and the housing 105*u,l*. The annulus may be longitudinally formed between a bottom of the upper housing section 105*u* and a shoulder 104 of the lower housing section 105*l*. The valve sleeve 151 may be longitudinally movable between an open position (FIG. 2A) and a closed position (FIG. 3A) by the actuator. In the open position, the housing ports 101 and the swivel port 121*p* may be in fluid communication via a radial fluid path. In the closed position, the valve sleeve 151 may isolate the housing ports 101 from the swivel port 121*p*, thereby preventing fluid communication between the ports. The actuator may be hydraulic and include a piston 151*p*, a biasing member, such as a spring 152, one or more hydraulic ports, such as an inlet 153*i* and an outlet 153*o*, one or more seals 154*a-c*, a hydraulic chamber 155, and one or more hydraulic valves 156*i,o* (see FIGS. 4A and 4B). Alternatively, the actuator may be electric or pneumatic.

The annulus may be divided into a spring chamber, the hydraulic chamber 155, and the fluid path. The spring 152 may be disposed in the spring chamber and may be disposed against the bottom of the upper housing section 105*u* and the piston 151*p*, thereby biasing the valve sleeve 151 toward the closed position. A top of the valve sleeve 151 may form the piston 151*p* and the piston may isolate the spring chamber from the hydraulic chamber. The seals 123*a*, 154*a* may be respectively disposed between the swivel sleeve 121 and the upper housing section 105*u* and between the upper housing section and the lower housing section 105*l* and may seal the top of the spring chamber. The seal 154*a* may be one or more polymer seal rings. One or more equalization ports 103 may be formed radially through a wall of the lower housing section 105*l* and may provide fluid communication between the spring chamber and the housing bore. The seal 154*b* may be disposed in an outer surface of the piston 151*p*, may isolate the spring chamber from the hydraulic chamber 155, and may be a stack of polymer seal rings. The seal 154*c* may be disposed in an inner surface of the piston 151*p*, may isolate the spring chamber from the fluid path, and may be a stack of polymer seal rings. The seal 123*b* may be disposed in an inner surface of the swivel sleeve 121 and may isolate the hydraulic chamber 155 from the fluid path. The seals 123*c,d* may be respectively disposed in an inner surface of the swivel sleeve 121 and between the swivel sleeve and the lower housing section 105*l* and may seal the bottom of the annulus.

Additionally, the RCFS 100 may include one or more lubricant reservoirs (not shown) in fluid communication with a respective one of the bearings 122*u,l*. The reservoirs may each be pressurized by a balance piston in fluid communication with the housing bore.

Figure 4A:
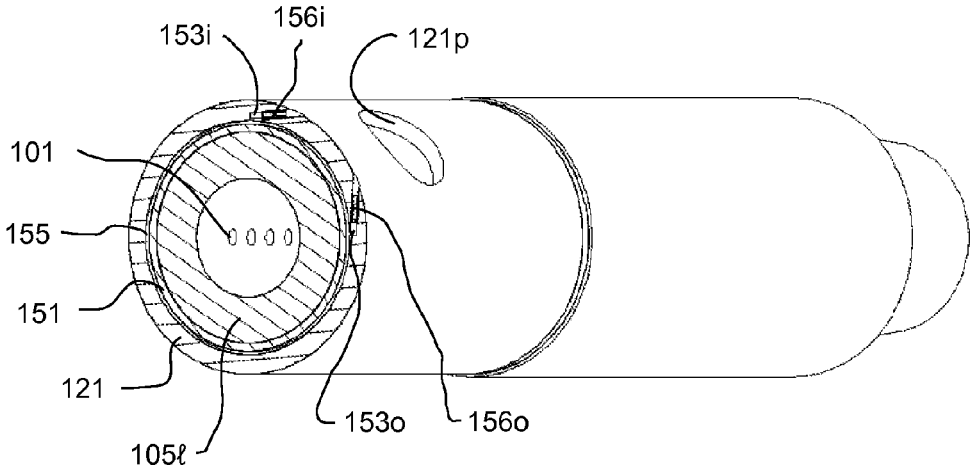
FIG. 4A is an isometric-sectional view of hydraulic ports of the RCFS.

FIG. 4A is an isometric-sectional view of the hydraulic ports 153*i,o* of the RCFS 100. Although shown as longitudinal/radial ports in FIGS. 2 and 3, the hydraulic ports 153*i,o* may actually extend radially and circumferentially through the wall of the swivel sleeve 121. One of the hydraulic valves 156*i,o* may be disposed in a respective hydraulic port 153*i,o*. The hydraulic valves 156*i,o* are shown externally of the ports in FIG. 4B for the sake of clarity only. The inlet hydraulic valve 156*i* may be a check valve operable to allow hydraulic fluid flow from a hydraulic power unit (HPU) 170 to the chamber 155 and prevent reverse flow from the chamber to the HPU. The check valve 156*i* may include a spring having substantial stiffness so as to prevent return fluid from entering the chamber should an annulus pressure spike occur while the RCFS 100 is in the wellbore 21. The outlet hydraulic valve 156*o* may be a pressure relief valve operable to allow hydraulic fluid flow from the chamber to the HPU when pressure in the chamber exceeds pressure in the HPU by a predetermined differential pressure.

Figure 4B:
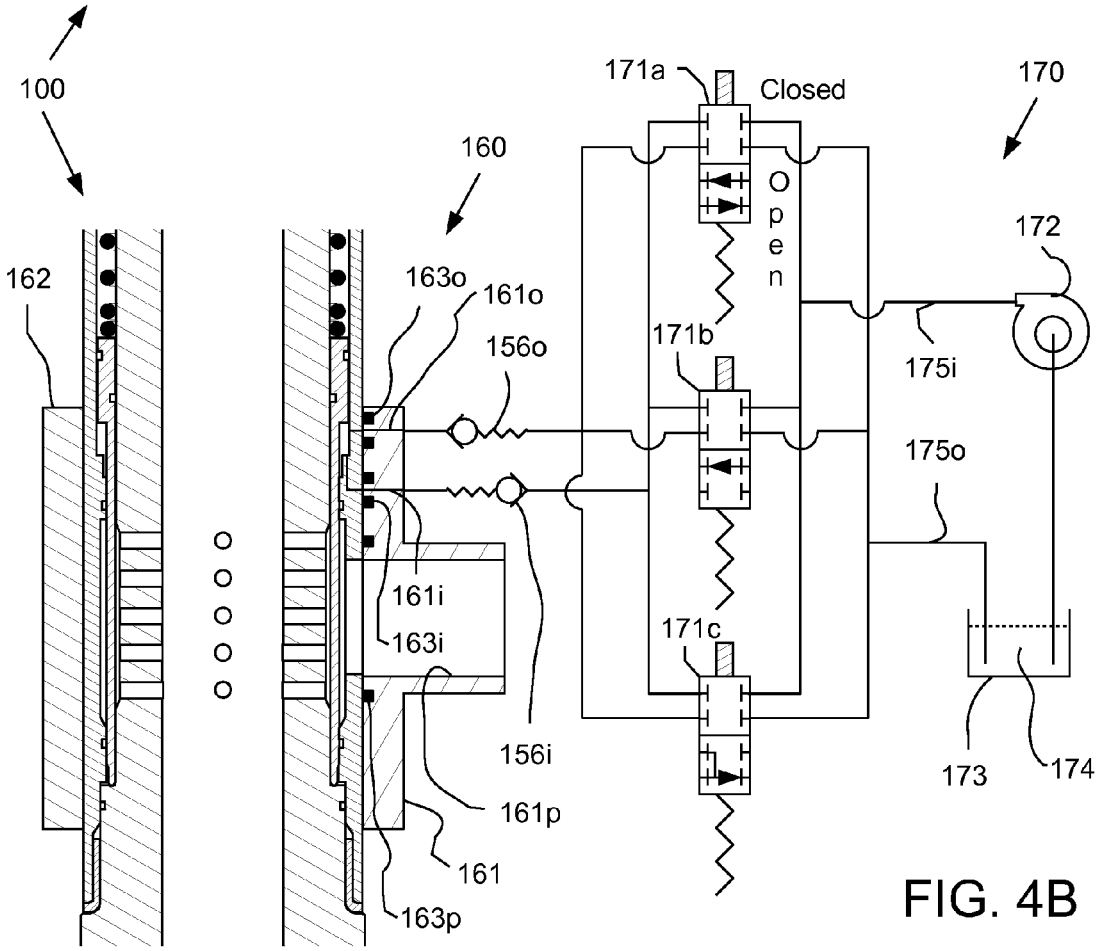
FIG. 4B is a hydraulic diagram illustrating a clamp and a hydraulic power unit for operating the RCFS between the positions.

FIG. 4B is a hydraulic diagram illustrating a clamp 160 and the HPU 170 for operating the RCFS 100 between the positions. The clamp 160 may include a body 161, one or more bands 162 pivoted to the body, such as by a hinge (not shown, see 315 in FIG. 6B), and a latch (not shown, see 320*p*, 322*p* in FIG. 6B) to operable to fasten the bands to the body. The clamp 160 may be movable between an opened position (not shown) for receiving the RCFS 100 and a closed position for surrounding an outer surface of the swivel sleeve 121. The clamp 160 may further include a tensionser (not shown, see FIG. 6B) operable to tightly engage the clamp with the swivel sleeve 121 after the latch has been fastened. The body 161 may have a circulation port 161*p* formed therethrough and hydraulic ports 161*i,o* formed therethrough corresponding to each of the swivel sleeve ports 153*i,o*. The body 161 may further have a profile (not shown) for connection of the hose 29. The body 161 may further have one or more seals 163*i,o,p* disposed in an inner surface thereof corresponding to each of the body ports 161*i,o,p*. When engaged with swivel sleeve 121, the seals 163*i,o,p* may provide sealed fluid communication between the body ports 161*i,o,p* and respective swivel sleeve ports 153*i,o*, 121*p*. Each of the body 161 and the swivel sleeve 121 may further include mating locator profiles (see dowel 329 in FIG. 6B) for alignment of the clamp body with the swivel sleeve.

Alternatively, the bands 162 and latch may be replaced by automated (i.e., hydraulic) jaws. Such jaws are discussed and illustrated in U.S. Pat. App. Pub. No. 2004/0003490 (Atty. Dock. No. WEAT/0368.P1), which is herein incorporated by reference in its entirety.

Additionally, the clamp 160 may be deployed using a beam assembly, discussed and illustrated in the '607 provisional application at FIG. 4A and the accompanying discussion therewith. The beam assembly may include a one or more fasteners, such as bolts, a beam, such as an I-beam, a fastener, such as a plate, and a counterweight. The counterweight may be clamped to a first end of the beam using the plate and the bolts. A hole may be formed in the second end of the beam for connecting a cable (not shown) which may include a hook for engaging the hoist ring. One or more holes (not shown) may be formed through a top of the beam at the center for connecting a sling which may be supported from the derrick 1 by a cable. Using the beam assembly, the clamp 160 may be suspended from the derrick 1 and swung into place adjacent the RCFS 100 when needed for adding joints or stands to the drill string and swung into a storage position during drilling.

Figures 4C, 9E:
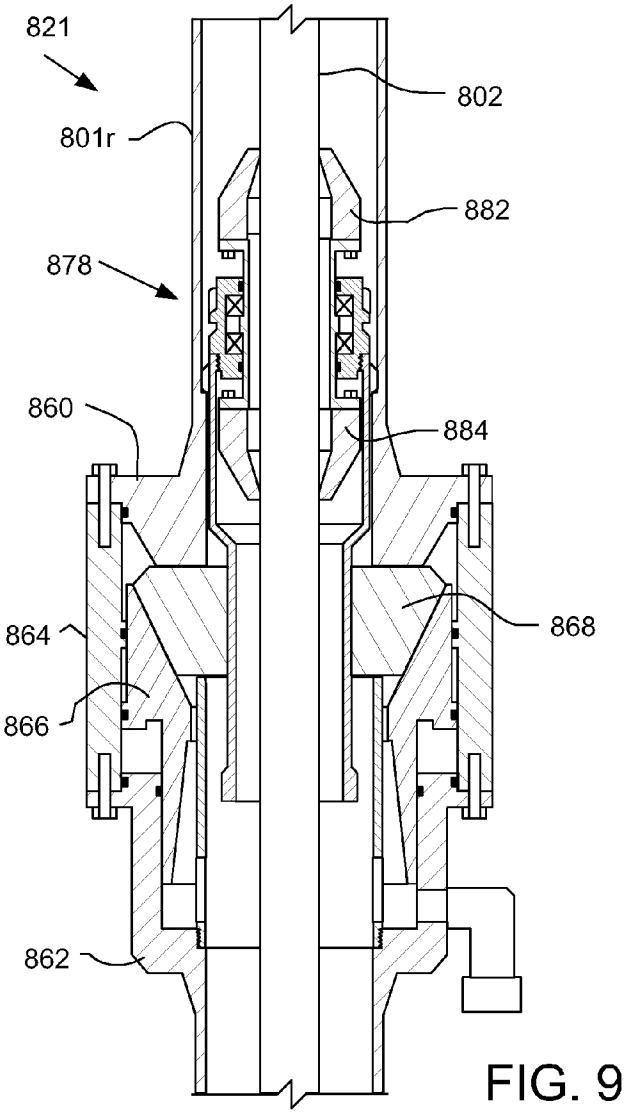
FIG. 4C is a table illustrating operation of the RCFS.
FIG. 9E is a cross-sectional view of a rotating control device (RCD) for use with one or more of the downhole RCFSs.

Alternatively, the clamp 160 may be deployed using a telescoping arm, discussed and illustrated in the '607 provisional application at FIGS. 4B-4D and the accompanying discussion therewith. The telescoping arm may include a piston and cylinder assembly (PCA) and a mounting assembly. The PCA may include a two stage hydraulic piston and cylinder which is mounted internally of a telescopic structure which may include an outer barrel, an intermediate barrel and an inner barrel. The inner barrel may be slidably mounted in the intermediate barrel which is, may be in turn, slidably mounted in the outer barrel. The mounting assembly may include a bearer which may be secured to a beam by two bolt and plate assemblies. The bearer may include two ears which accommodate trunnions which may project from either side of a carriage. In operation, the clamp 160 may be moved towards and away from the RCFS 100 by extending and retracting the hydraulic piston and cylinder.

The HPU 170 may include a pump 172, one or more control valves 171*a-c*, a reservoir 173 having hydraulic fluid 174, and hydraulic conduits 175*i,o* connecting the pump, reservoir, and control valves to respective hydraulic ports of the clamp body. The control valves 171*a-c* may each be directional valves having an electric, hydraulic, or pneumatic actuator in communication with a programmable logic controller (PLC, see FIG. 5A) 180. Each control valve 171*a-c* may be operable between an open and a closed position and may fail to the closed position. In the open position, each control valve 171*a-c* may provide fluid communication between one or more of the RCFS hydraulic valves 156*i,o* and one or more of the pump 172 and reservoir 173.

FIG. 4C is a table illustrating operation of the RCFS 100. In operation, when a joint or stand needs to be added to the drill string, the clamp 160 may be closed around the swivel sleeve 121 and tightened to engage the swivel sleeve. The PLC 180 may then open control valve 171*a*, thereby providing fluid communication between the HPU pump 172 and the inlet valve 156*i* and between the HPU reservoir 173 and the outlet valve 1560. The pump 172 may then inject hydraulic fluid 174 into the chamber 155. Once pressure in the chamber 155 exceeds the differential pressure, fluid 174 may exit the chamber 155 through the outlet valve 156*o* to the HPU reservoir 173, thereby displacing any air from the chamber. Once the RCFS chamber 155 has been bled, the PLC 180 may close the control valve 171*a* and then open the control valve 171*b*, thereby providing fluid communication between the HPU pump 172 and the inlet valve 156*i* and preventing fluid communication between the HPU reservoir and the outlet valve 1560. The pump 172 may then inject hydraulic fluid 174 into the chamber.

Once pressure in the chamber 155 exerts a fluid force on a lower face of the piston 151*p* sufficient to overcome a fluid force exerted on an upper face of the piston exerted by the drilling fluid and the force exerted by the spring 152, the port sleeve 151 may move upward to the open position (FIG. 3A). Drilling fluid may then be injected into the RCFS ports 101 and the joint/stand added to the drill string. Once the joint/stand has been added, the PLC 180 may close the control valve 171*b* and then open the control valve 171*c*, thereby providing fluid communication between the hydraulic valves 156*i,o* and the HPU reservoir 173. The forces exerted on the upper face of the piston 151*p* may pressurize the fluid in the hydraulic chamber 155 until the hydraulic fluid 174 exceeds the differential pressure. The hydraulic fluid 174 may then exit the chamber 155 through the outlet valve 156*o* and to the reservoir 173, thereby allowing the valve sleeve 151 to close. Once the valve sleeve 151 has closed, the PLC 180 may close the control valve 171*c* and the clamp 160 may be removed. The differential pressure may be set to be equal to or substantially equal to the drilling fluid pressure so that the pressure in the hydraulic chamber remains equal to or slightly greater than the drilling fluid pressure, thereby ensuring that drilling fluid does not leak into the hydraulic chamber 155.

FIGS. 5A-51 illustrate a drilling operation using a plurality of RCFSs 100*a,b*, according to another embodiment of the present invention.

The drilling rig may include the derrick 1 (FIG. 1), a top drive 50, a torque sub 52, a compensator 53, a grapple 54, a pipe handler 55, an elevator (not shown), a control system, and a rotary table 70 supported from a platform 71. The platform 71 may be located adjacent a surface of the earth over the wellbore 21 extending into the earth. Alternatively, the platform 71 may be located adjacent a surface of the sea and the wellbore 21 may be subsea. The rig may further include a traveling block 2 (FIG. 1) that is suspended by wires from draw works and holds a quill or drive shaft of the top drive 50. The top drive 50 may include a motor for rotating a drill string 60. The top drive motor may be either electrically or hydraulically driven. Additionally or alternatively, the drill bit 20 may be rotated by a mud motor (not shown) assembled as part of the drill string proximate to the drill bit. Additionally, the top drive 50 may be coupled to a rail of the rig for preventing rotational movement of the top drive during rotation of the drill string and allowing for vertical movement of the top drive under the traveling block 2. The grapple 54 may longitudinally and rotationally couple the drill string 60 to the quill. The grapple 54 may be a torque head. The torque head 54 may be hydraulically operated to grip or release the drill string 60. Periodically, one or more joints of drill pipe 8 may be added to the drill string 60 to continue drilling of the wellbore 21.

The rotary table 70 may include a drive motor (FIG. 1), slips 73, a bowl 72, and a piston 74. The slips 73 may be wedge-shaped arranged to slide along a sloped inner wall of the bowl 72. The slips 73 may be raised and lowered by the piston 74. When the slips 73 are in the lowered position, they may close around the outer surface of the drill string 60. The weight of the drill string 60 and the resulting friction between the drill string 60 and the slips 73 may force the slips downward and inward, thereby tightening the grip on the drill string. When the slips 73 are in the raised position, the slips are opened and the drill string 60 is free to move longitudinally in relation to the slips. The drive motor may be operable to rotate the rotary table relative to the platform 71.

The rotary table 70 may further include a stationery slip ring 75. The stationery slip ring 75 may be positioned around the outside of the bowl 72. The stationery slip ring 75 may include couplings to secure fluid paths between the rotary table 70 and the stationery platform 71. These fluid paths may conduct hydraulic fluid to operate the piston 74. The fluid paths may port to the outside of the bowl 72 and align with corresponding recesses along the inside of the slip ring 75. Seals may prevent fluid loss between the bowl 74 and the slip ring 75. The couplings may connect hydraulic line, such as hoses, that supply the fluid paths. The rotary table 70 may also include a rotary speed sensor.

The control system may include the PLC 180, the HPU 170, one or more pressure sensors G1-G3, a flow meter FM, and one or more control valves V1-V5. Control valves V1, V2 may be shutoff valves, such as ball or butterfly, or they may be metered type, such as needle. If control valves V1 and V2 are metered valves, the PLC 180 may gradually open or close them, thereby minimizing pressure spikes or other deleterious transient effects. Pressure sensors G1-G3 may be disposed in the header 39, pressure sensor G2 may be disposed downstream of control valve V1, and pressure sensor G3 may be disposed downstream of control valve V2. The flow meter FM may be disposed in communication with an outlet of the mud pump 18. The pressure sensors G1-G3 and flow meter FM may be in data communication with the PLC 180. The PLC 180 may also be in communication with actuators of the control valves V1-V5, the draw works, the top drive motor, the torque sub 52, the compensator 53, the grapple 54, the pipe handler 55, the HPU 170, and the rotary table 70 to control operation thereof. The PLC 180 may be microprocessor based and include an analog and/or digital user interface. The PLC 180 may further include an additional HPU (not shown) or the HPU 170 may instead be connected to the rig components for operation thereof (except the top drive motor and the draw works may have their own power units and the PLC may interface with those power units). The PLC 180 may further be in communication with the mud pump for control thereof. Alternatively, the rig components may be pneumatically or electrically actuated.

The torque sub 52 is discussed and illustrated in the '607 provisional application at FIG. 15A and the accompanying discussion therewith. The torque sub may include a torque shaft having one or more strain gages disposed thereon and oriented to measure torsional deflection of the torque shaft. The torque sub may further include a wireless power coupling and/or a wireless data transmitter/transceiver. The torque sub may further include a turns counter.

A suitable pipe handler 55 is discussed and illustrated in U.S. Pat. Pub. No. 2004/0003490, which is herein incorporated by reference in its entirety. The pipe handler 55 may include a base at one end for coupling to the derrick, a telescoping arm for radially moving a head about the base, and the head having jaws for gripping the drill string.

Alternatively, the top drive 50 may be connected to the drill string 60 with a threaded connection directly to the quill or via a thread saver instead of using the grapple 54 and the top drive 50 may include a back-up tong to makeup or breakout the threaded connection with the drill string 60. Alternatively, the pipe handler 55 may be omitted.

Figure 5A:
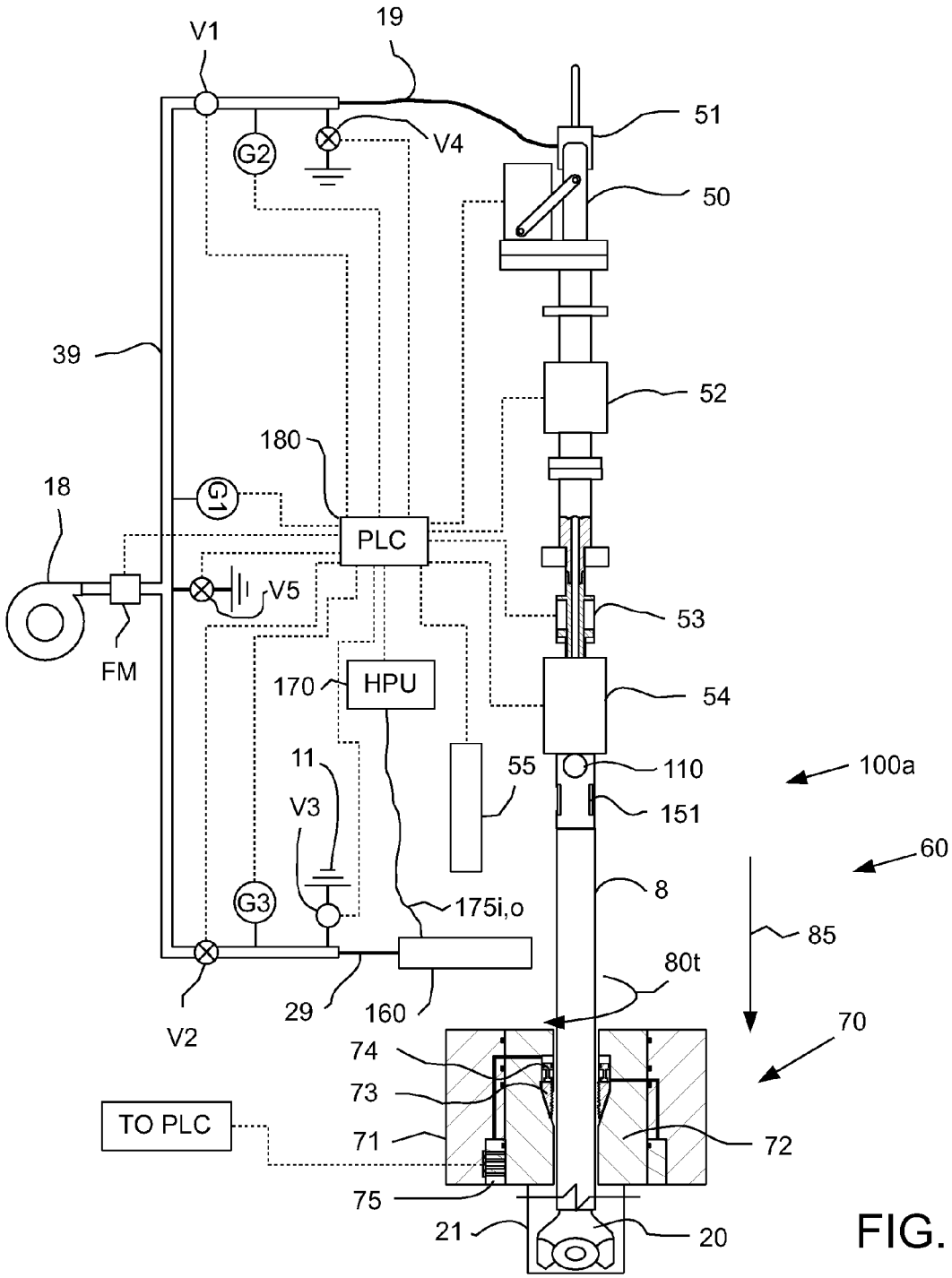
FIGS. 5A-5I illustrate a drilling operation using the RCFS, according to another embodiment of the present invention.

Referring specifically to FIG. 5A, the top drive 50 may rotate 80*t* the drill string 60 having the drill bit 20 at an end thereof while drilling fluid (FIG. 1), such as mud, is injected through the drill string 60 and bit 20 and while the top drive 50 and drill string 60 are being advanced 85 longitudinally into the wellbore 21, thereby drilling the wellbore. The mud pump 18 may inject drilling fluid into a top of the drill string 60 via header 39, hose 19, swivel 51, and the top drive quill. The valves V1, V3, and 110 may be open.

Figure 5B:
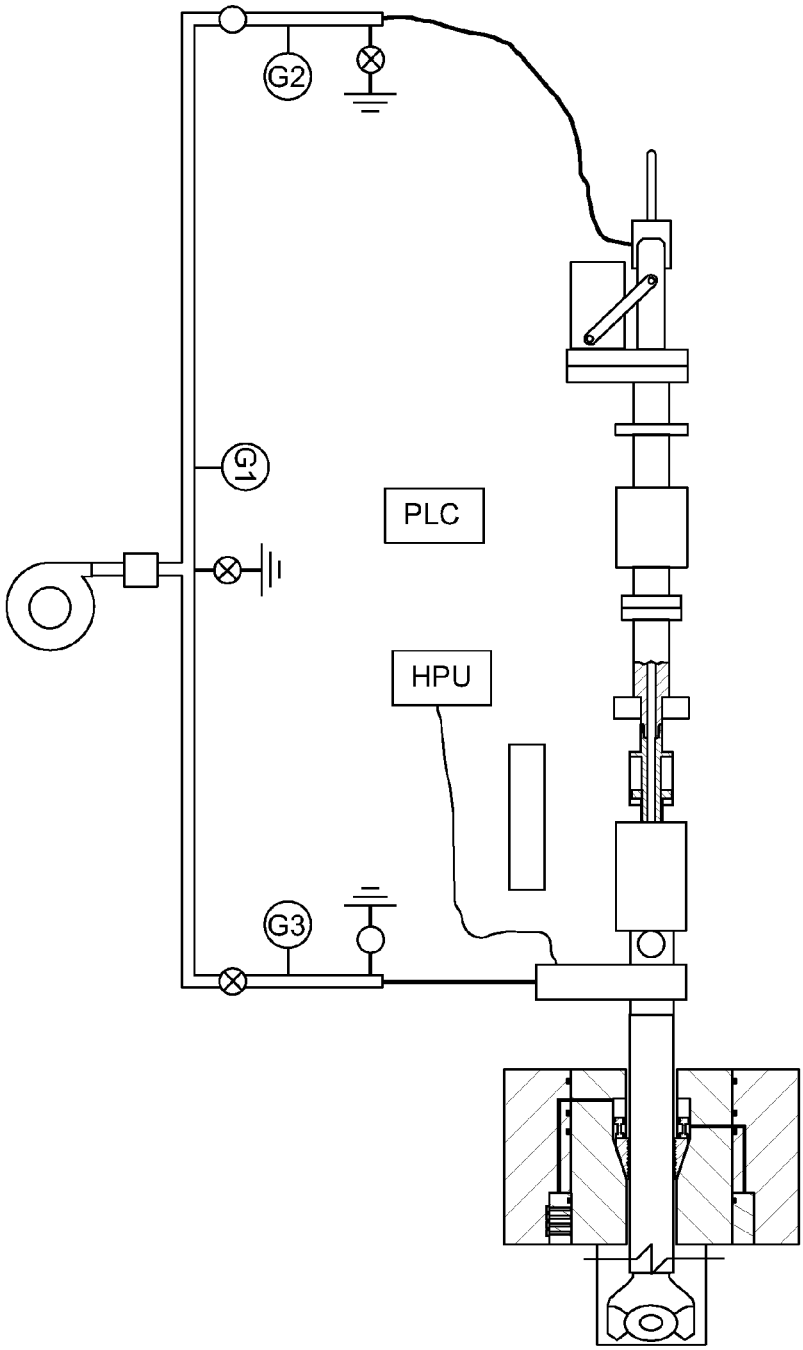

Referring specifically to FIG. 5B, once it is necessary to extend the drill string 60, drilling may be stopped by stopping advancement 85 and rotation 80*t* of the top drive 50. The slips 73 may then be lowered to engage the drill string 60, thereby longitudinally supporting the drill string 60 from the platform 71. The clamp 160 may be transported to the RCFS 100, closed, and engaged by the rig crew. The driller may maintain or substantially maintain the current mud pump flow rate or change the mud pump flow rate. The change may be an increase or decrease. The PLC 180 may then close valve V3 and apply pressure to the clamp circulation port 161*p* by opening valve V2 and then closing valve V2. If the clamp 160 is not securely engaged, drilling fluid will leak past the seal 163*p*. The PLC 180 may verify sealing integrity by monitoring pressure sensor G3. The PLC 180 may then relieve pressure by opening valve V3. The PLC 180 may then close valve V3.

Figure 5C:
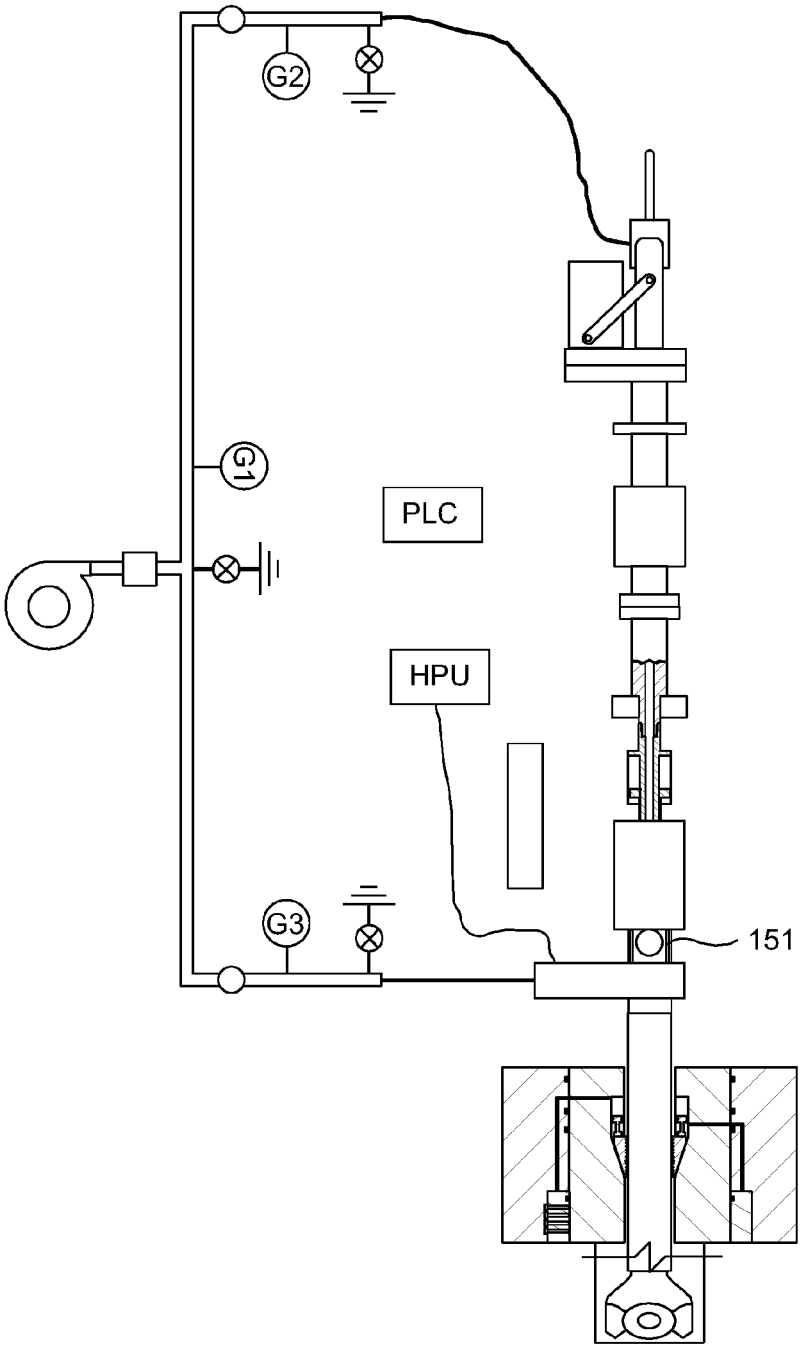

Referring specifically to FIG. 5C, the PLC 180 may then operate the HPU 170 to open the valve sleeve 151, as discussed above. Once the valve sleeve 151 is open, the PLC 180 may verify opening by monitoring pressure sensor G3. The PLC 180 may then open valve V2 to inject the drilling fluid through the RCFS side ports 101 and into the drill string bore. Drilling fluid may be flowing into the drill string through both the side ports 101 and the top.

Figure 5D:
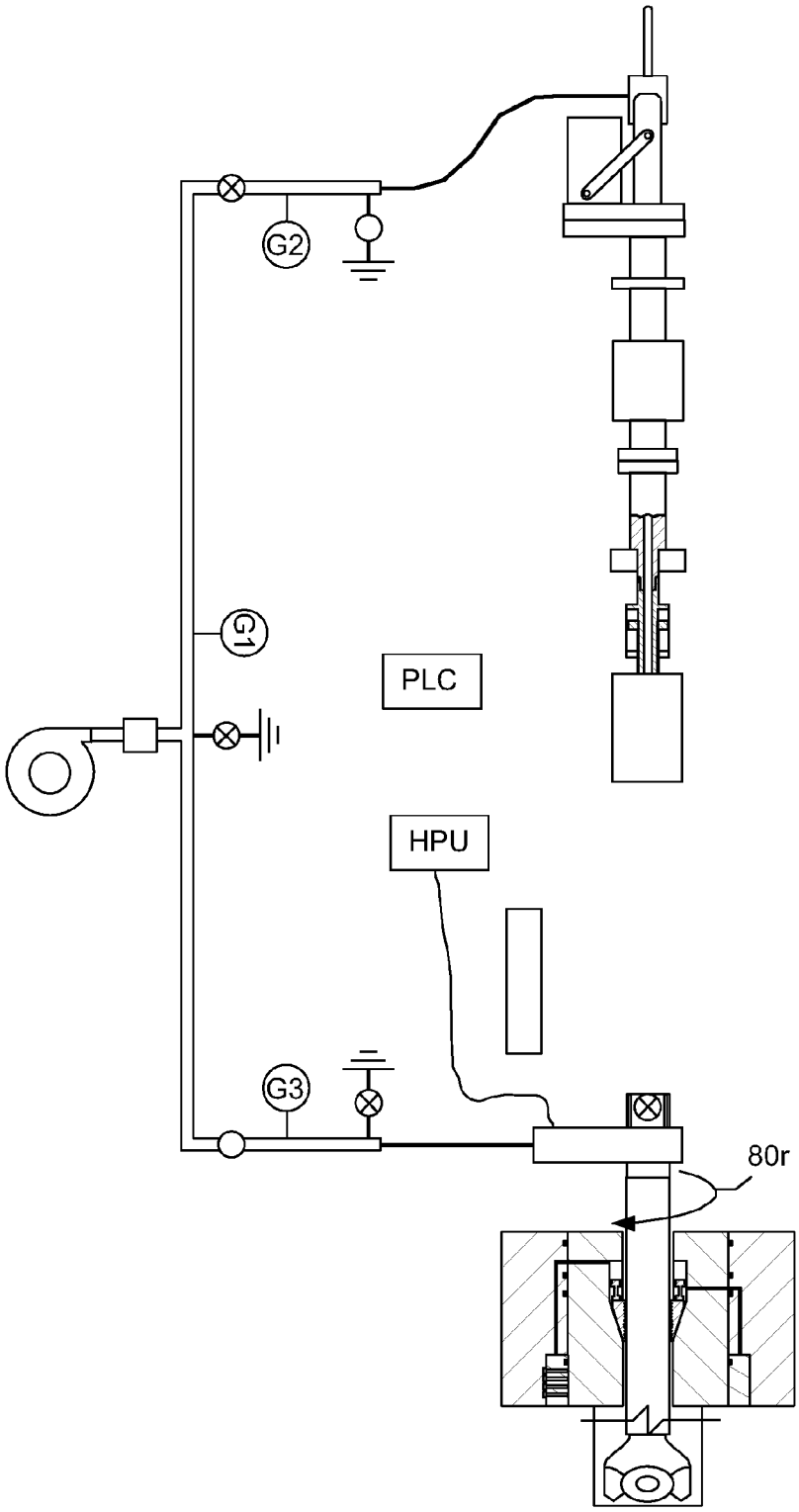

Referring specifically to FIG. 5D, the PLC 180 may then close valve V1. The rig crew may then close the bore valve 110. The PLC 180 may then open valve V4, thereby relieving pressure from the top drive 50. The PLC may verify that the bore valve 110 is closed by monitoring pressure sensor G2. The table drive motor may then be operated to rotate 80*r* the bowl 72 and drill string 60. The table drive motor may rotate the drill string 60 at an angular speed equal to, less than, or substantially less than an angular speed that the top drive 50 rotated the drill string 60 during drilling, such as less than or equal to three-quarters, two-thirds, or one-half the drilling angular speed. The torque head 54 may then be operated to release the drill string 60 and the top drive 50 may be moved upward away from the drill string 60.

Alternatively, if the threaded connection with the quill is used instead of the torque head 54, the top drive 50 may hold the quill rotationally stationary while the rotary table 70 rotates the drill string 60, thereby breaking out the connection between the quill and the drill string. The compensator 53 may be operated to account for longitudinal movement of the connection.

Figure 5E:
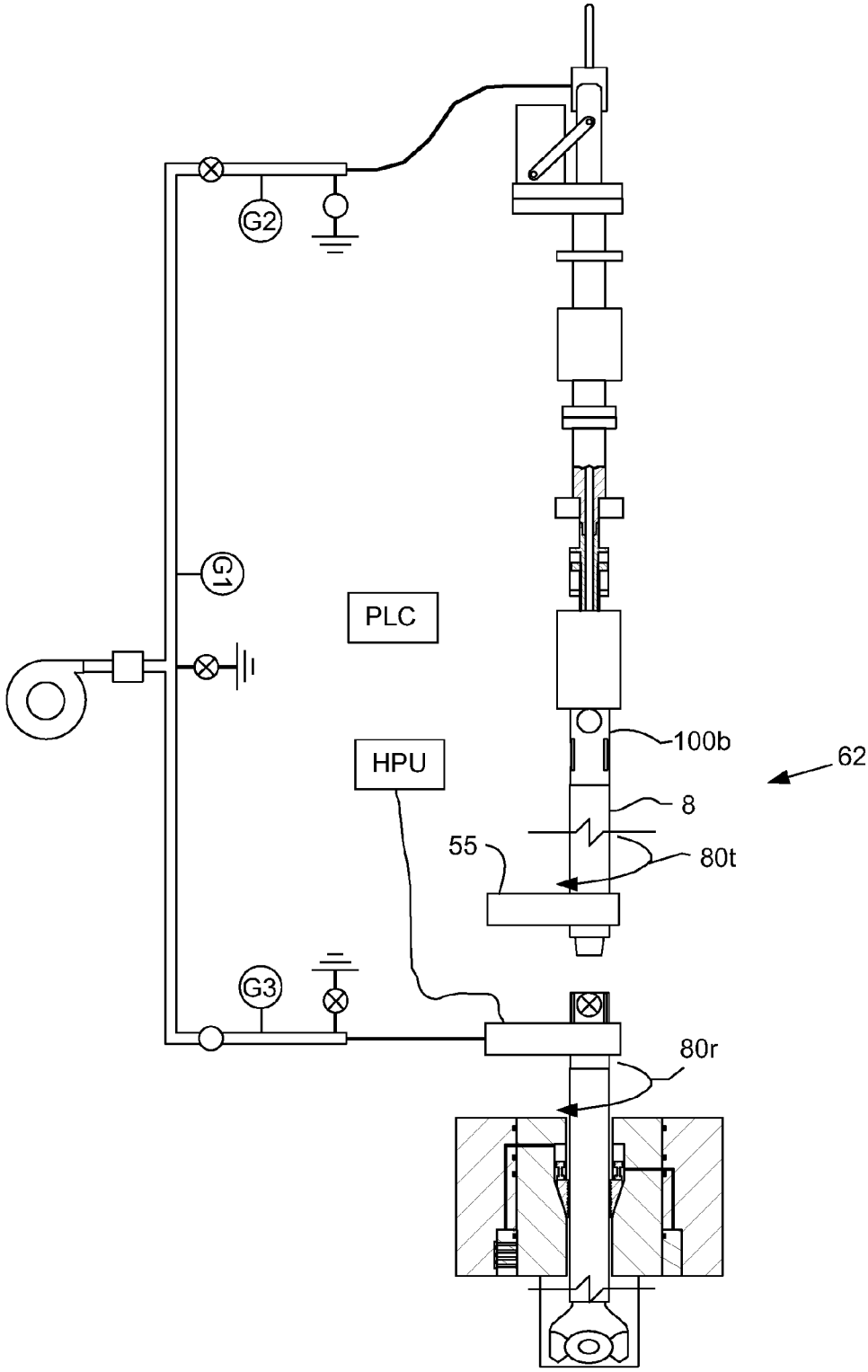

Referring specifically to FIG. 5E, the top drive 50 may then engage the stand 62 from a stack or the V-door with the aid of the elevator and the pipe handler 55. The stand 62 may be preassembled and include an RCFS 100*b* connected to one or more joints of drill pipe 8 by a threaded connection. Engagement of the stand 62 by the top drive 50 may include grasping the stand using the torque head 54. The top drive 50 may then move the stand 62 into position above the drill string 60. The top drive 50 and/or pipe handler 55 may then rotate 80*t* the stand 62 at an angular speed corresponding to the drill string 60 being rotated by the rotary table.

Alternatively, only an RCFS without drill pipe joints may be added to the drill string 60.

Figure 5F:
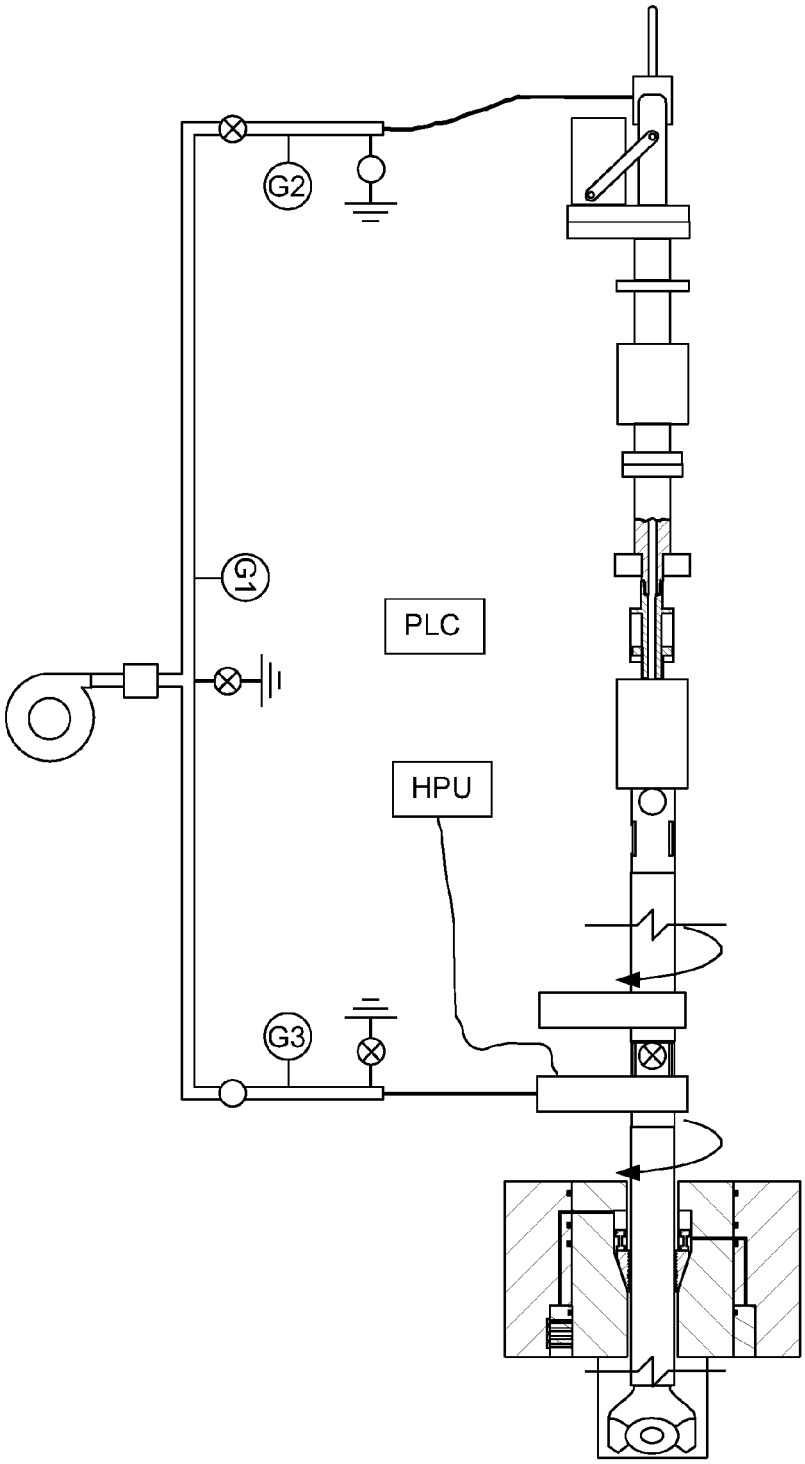

Referring specifically to FIG. 5F, a pin of the stand 62 may then be engaged with the box 105*b* of the RCFS housing 105*u*. The rotational speed of the top drive/pipe handler 50,55 may be increased relative to the drill string 60, thereby making up the threaded connection between the stand 60 and the RCFS 100. If the pipe handler 55 is equipped with a spinner, the pipe handler 55 may make up a first portion of the connection and the top drive 50 may make up a second portion of the connection. The compensator 53 may be operated to account for vertical movement of the threaded connection. The torque sub 52 may measure torque and rotation of the stand relative to the drill string as the connection is made up. The pipe handler 55 may also compensate for longitudinal movement during makeup.

Alternatively, the stand pin may be engaged with the box thread before rotation of the stand by the top drive.

Figure 5G:
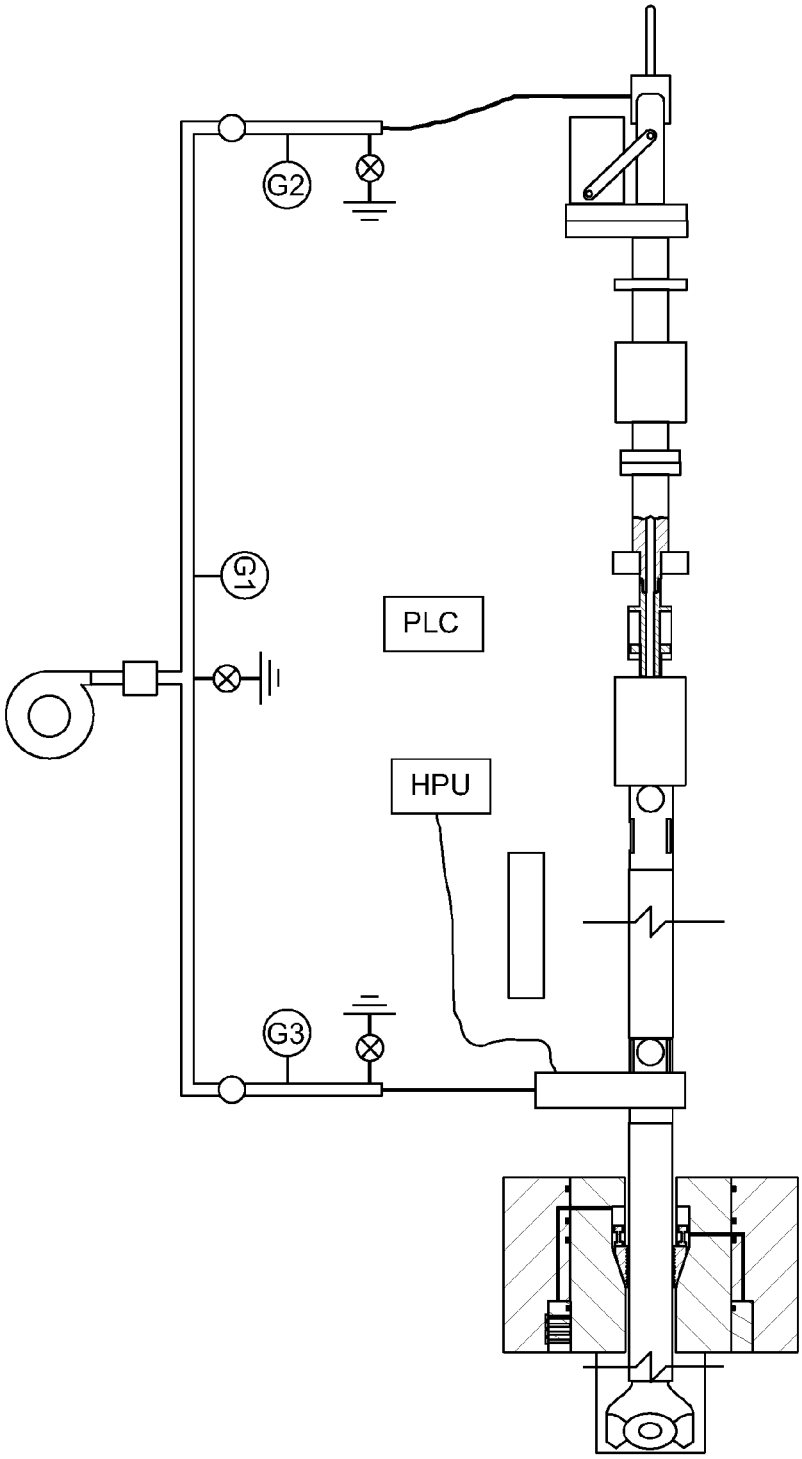

Referring specifically to FIG. 5G, once the threaded connection between the stand 62 and the drill string 60 is made up, rotation of the drill string 60,62 may be stopped. The bore valve 110 may be opened by the rig crew. The PLC 180 may then close valve V4. The PLC may open the valve V1, thereby allowing drilling fluid flow from the mud pump 18, through the hose 19, and into a top of the drill string 60,62. The PLC 180 may verify opening of the valve V1 by monitoring the pressure sensor G2.

Figure 5H:
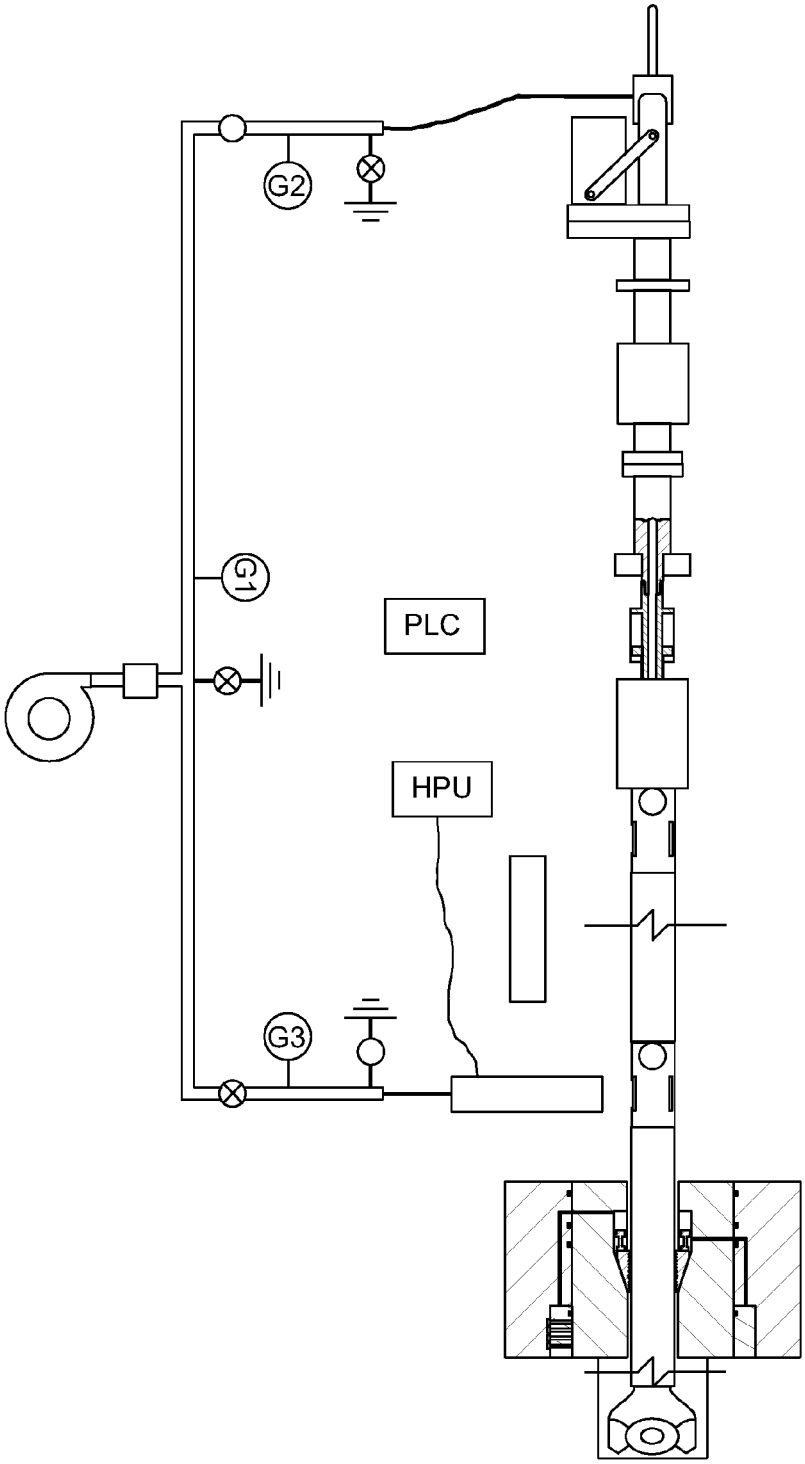
Figure 5I:
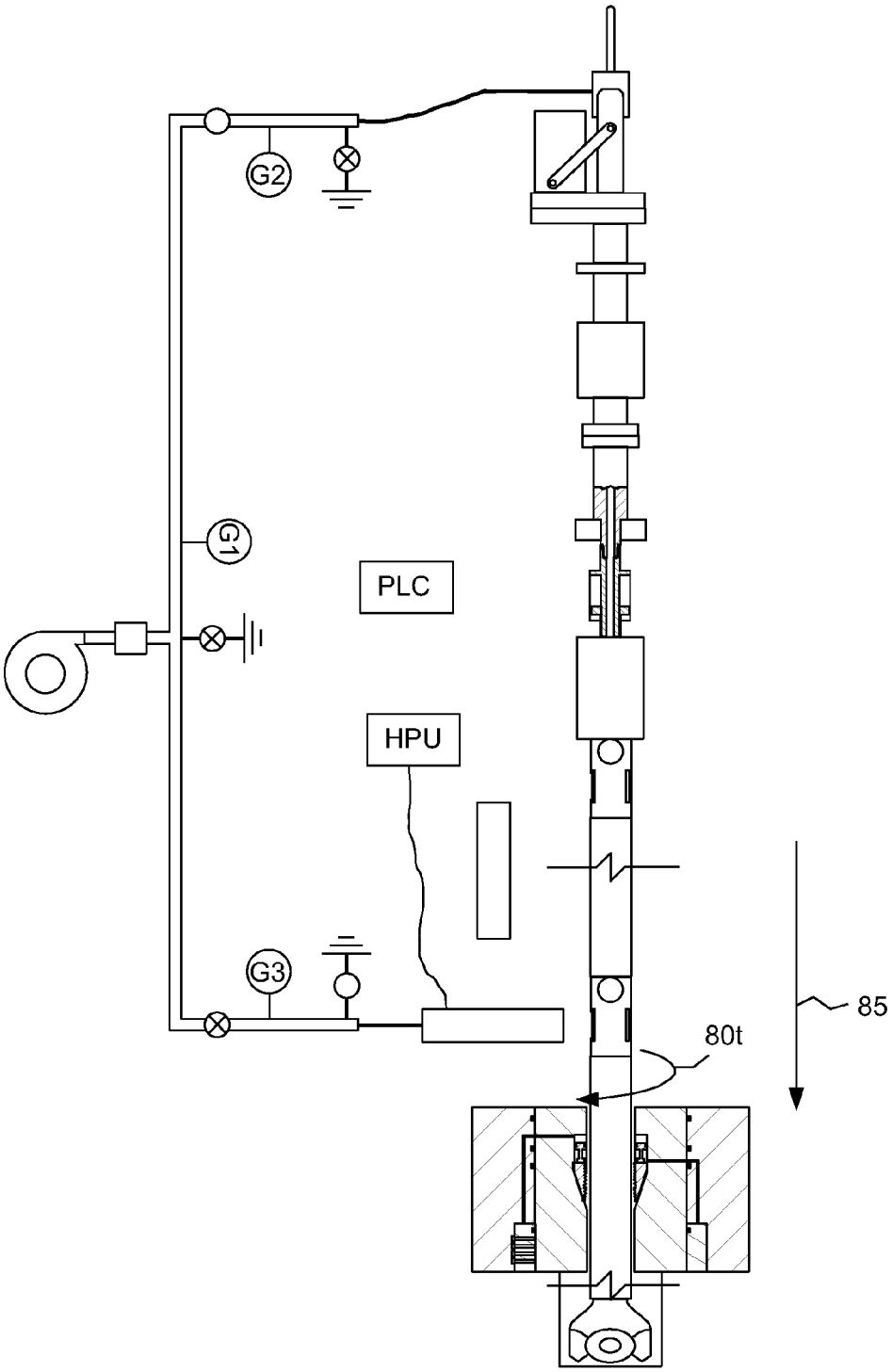

Referring specifically to FIG. 5H, the PLC 180 may then close valve V2 and operate the HPU 170 to close the valve sleeve 151, as discussed above. The PLC 180 may confirm closure of the valve sleeve 151 by opening valve V3 to relieve pressure, closing valve V3, and monitoring pressure sensor G3. The PLC 180 may then open the valve V3. The rig crew may then disengage the clamp 160, open the clamp, and transport the clamp away from the RCFS 100.

Referring specifically to FIG. 5*l*, the PLC 180 may then disengage the slips 73, return the mud pump flow rate (if it was changed from the drilling flow rate), rotate 80*t* the drill string 60 at the drilling angular speed, and advance 85 the drill string 60,62 into the wellbore 21, thereby resuming drilling of the wellbore.

If, at any time, a dangerous situation should occur, an emergency stop button (not shown) may be pressed, thereby opening the vent valves V3-V5 and closing the supply valves V1 and V2, (some of the valves may already be in those positions).

Advantageously, rotation of the drill string 60 while making up the connection may reduce likelihood of differential sticking of the drill string to the wellbore.

A similar process may be employed if/when the drill string 60 needs to be tripped, such as for replacement of the drill bit 20 and/or to complete the wellbore. The steps may be reversed in order to disassemble the drill string. Alternatively, the method may be utilized for running casing or liner to reinforce and/or drill the wellbore, or for assembling work strings to place wellbore components in the wellbore. Alternatively, a power tong may be used to make up the connection between the stand and the drill string instead of the top drive and/or pipe handler. Additionally, a backup tong may be used with the power tong.

Figure 6:
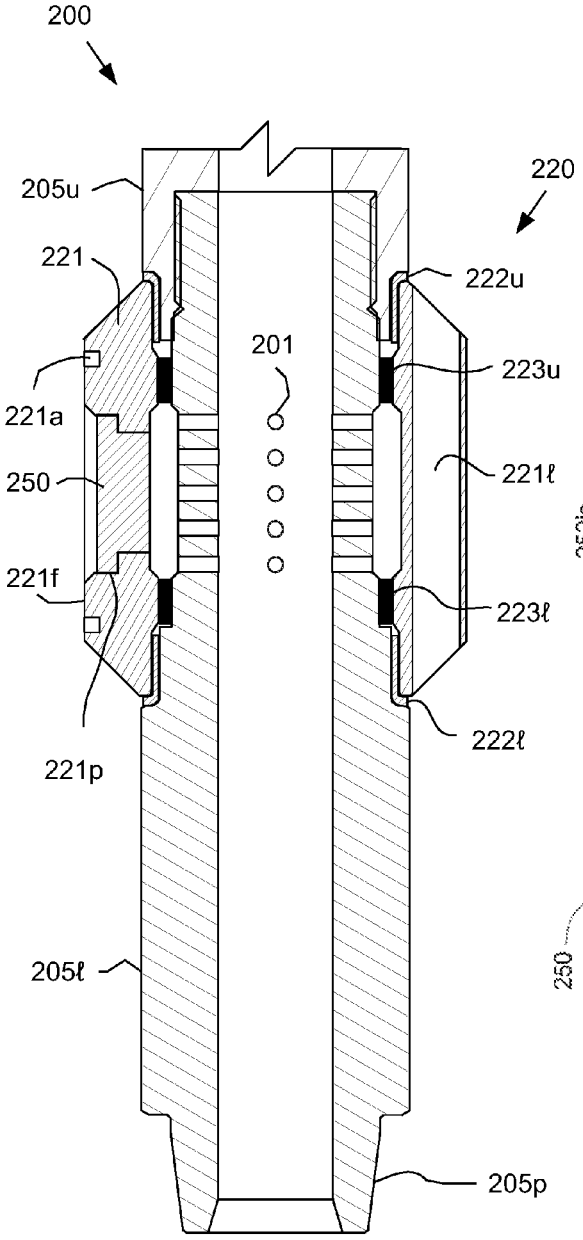
FIG. 6 is a cross-sectional view of a portion of an RCFS, according to another embodiment of the present invention.

FIG. 6 illustrates a portion of an RCFS 200, according to another embodiment of the present invention. The RCFS 200 may include a tubular housing 205*u,l*, a bore valve (not shown, see 110), a swivel 220, and a plug 250. The housing 205*u,l*, may be similar to the housing 105*u,l* and include the pin 205*p* and the ports 201. The swivel 220 may include a case 221, one or more bearings, such as an upper bearing 222*u* and a lower bearing 222*l*, and one or more seals 223*u,l*. The seals 223*u,l* and bearings 222*u,l* may be similar to the seals 123*a-c* and bearings 122*u,l*, respectively.

The case 221 may be disposed between the upper 205*u* and lower 205*l* housing sections, thereby longitudinally coupling the case to the housing. The case 221 may have a radial port 221*p* formed through a wall thereof and the radial port 221*p* may be aligned with the housing ports 201. The case 221 may also have one or more longitudinal passages 221*l* formed through a wall thereof. The bearings 222*u,l* may be disposed between respective ends of the case 221 and a respective housing section, thereby facilitating rotation of the housing 205*u,l* relative to the case. The case 221 may an outer diameter greater or substantially greater than that of the housing 205*u,l*. The case 221 may serve as a centralizer or stabilizer during drilling and may be made from a wear and erosion resistant material, such as a high strength steel or cermet. In order to maintain a tubular seal face 221*f* for engagement with a clamp 300, the longitudinal passages 221*l* may serve to conduct returns therethrough during drilling so that the enlarged case does not obstruct the flow of returns. The case 221 may further have an alignment profile 221*a* for engagement with the clamp 300.

Figure 6A:
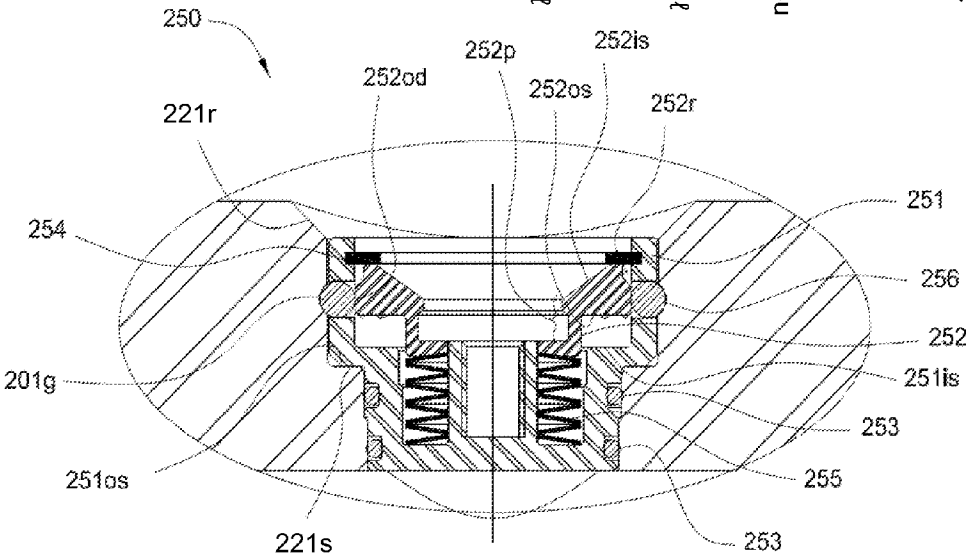
FIG. 6A is an enlargement of a plug of the RCFS.

FIG. 6A is an enlargement of the plug 250 of the RCFS 200. The plug 250 may have a curvature corresponding to a curvature of the case 221. The plug 250 may include a body 251, a latch 252, 256, one or more seals, such as o-rings 253, a retainer, such as a snap ring 254, and a spring, such as a disc 255 or coil spring. The latch may include a locking sleeve 252 and one or more balls 256. The body 251 may be an annular member having an outer wall, an inner wall, an end wall, and an opening defined by the walls. The outer wall may taper from an enlarged diameter to a reduced diameter. The outer wall may form an outer shoulder 251*os* and an inner shoulder 251 is at the taper. The outer wall may have a radial port therethrough for each ball 256. The outer shoulder 251*os* may seat on a corresponding shoulder 221*s* formed in the case port 221*p*. The balls 256 may seat in a corresponding groove 201*g* formed in the wall defining the housing port 201, thereby fastening the body to the case 221. The case port 221*p* may further include a taper 221*r*. The plug 250 may be shielded from contacting the wellbore by the taper 221*r*, thereby reducing risk of becoming damaged and compromising sealing integrity. One or more seals, such as o-rings 253, may seal an interface between the plug body 251 and the case 221.

The locking sleeve 252 may be disposed in the body 251 between the inner and outer walls and may be longitudinally movable relative thereto. The locking sleeve 252 may be retained in the body by a fastener, such as snap ring 254. The disc spring 255 may be disposed between the locking sleeve and the body and may bias the locking sleeve toward the snap ring. An outer surface of the locking sleeve 252 may taper to form a recess 252*r*, an enlarged outer diameter 252*od*, and a shoulder 252*os*. One or more protrusions may be formed on the outer shoulder 252*os* to prevent a vacuum from forming when the outer shoulder seats on the body inner shoulder 251*is*. An inner surface of the locking sleeve may taper to form an inclined shoulder 252*is* and a latch profile 252*p*.

Figure 6B:
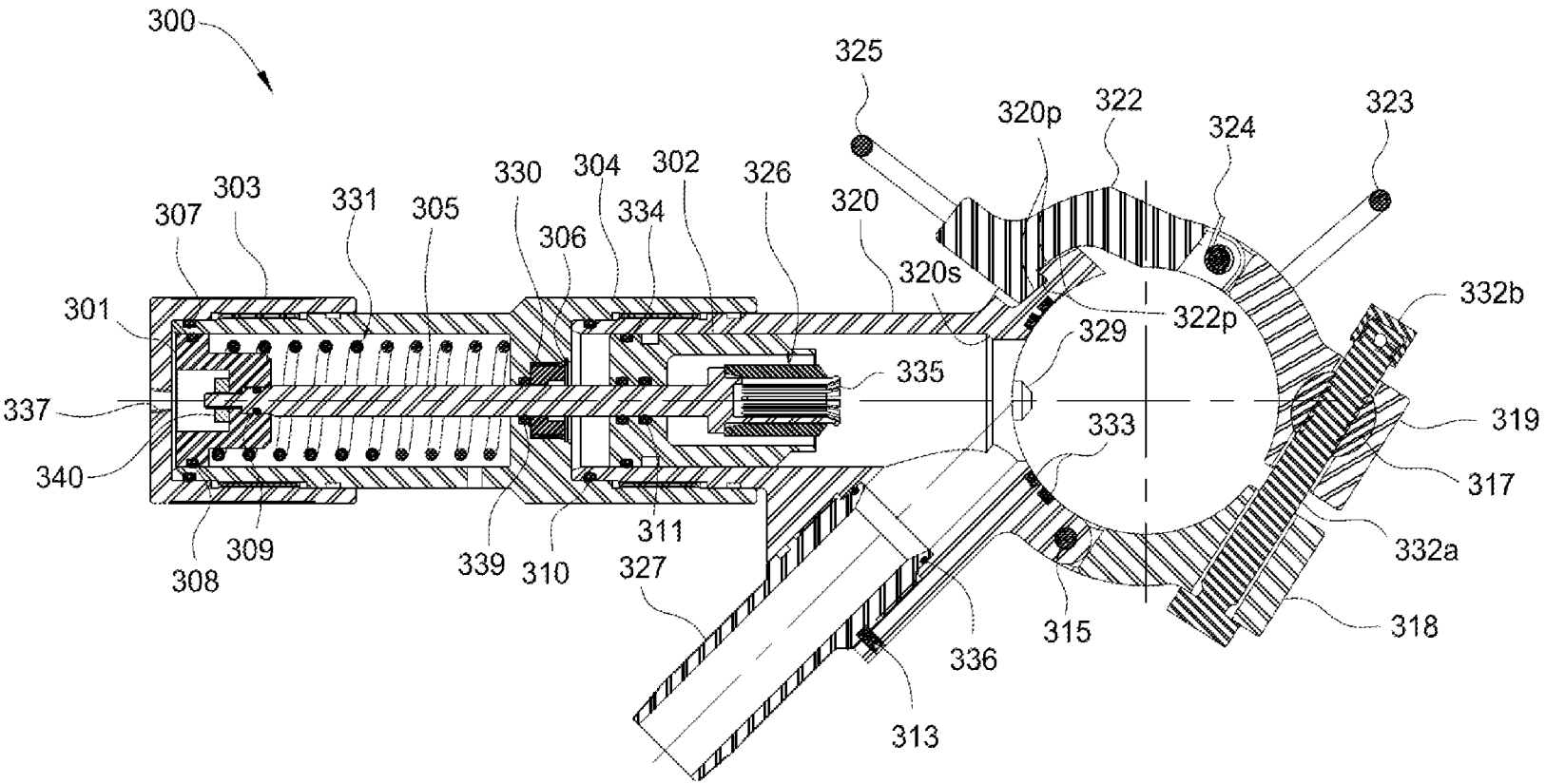
FIG. 6B is a cross-sectional view of a clamp for removing and installing the plug.

FIG. 6B is a cross-sectional view of the clamp 300 for removing and installing the plug 250. The clamp 300 may include a hydraulic actuator, such as a retrieval piston 301 and a retaining piston 302; an end cap 303, a chamber housing 304, a piston rod 305, a fastener, such as a snap ring 306; one or more seals, such as o-rings 306-311, 334, 336, 339; one or more fasteners, such as set screws 312, 313; one or more fasteners, such as nuts 314 and cap screws 315; one or more fasteners, such as cap screws 316; one or more fasteners, such as a tubular nut 317; one or more clamp bands 318,319; a clamp body 320; a clamp handle 321; a clamp latch 322; one or more handles, such as a clamp latching handle 323 and a clamp unlatching handle 325; one or more springs, such as torsion spring 324 and coil spring 331; a rod sleeve 326; a flow nipple 327; a hoist ring 328; a locator, such as dowel 329; a plug 330; a tension adjuster, such as bolt 332*a* and stopper 332*b*; one or more seals, such as rings 333; a latch, such as collet 335; one or more hydraulic ports 337, 338, and a fastener, such as nut 340. Alternatively, the clamp actuator may be pneumatic or electric. A more detailed discussion of the clamp components and operation thereof may be found in the '607 provisional at FIGS. 3, 3A, and 5A-E and the accompanying discussion therewith. Any of the deployment options and alternatives discussed above for the clamp 160 also apply to the clamp 300.

In operation, the RCFS 200 and the clamp 300 may be used in the drilling method, discussed above, instead of the RCFS 100 and the clamp 160. The HPU 170 may be modified (not shown) to operate the clamp 300.

Figure 7A:
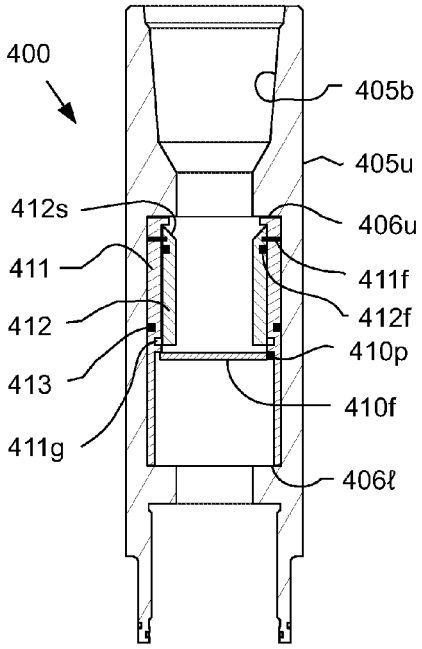
FIG. 7A is a cross-sectional view of a bore valve for the RCFS, according to another embodiment of the present invention.

FIG. 7A is a cross-sectional view of a portion of an RCFS 400, according to another embodiment of the present invention. The RCFS 400 may be similar to either of the RCFSs 100, 200 except for the substitution of a bore float valve 410 for the bore ball valve 110 and accompanying modifications to the RCFS housing 105*u* (now 405*u*). The float valve 410 may include a closure member, such as a flapper 410*f*, a body 411, and a locking sleeve 412. The body 411 may be disposed in a recess formed in the upper housing section 405*u*. The float valve 410 may be longitudinally coupled to the housing 705 by disposal between shoulders 406*u,l* formed in the upper housing section. Alternatively, the upper shoulder 406*u* may be omitted and the float valve 410 may be inserted into the upper housing section 405*u* via the box 405*b* and fastened to the housing 405*u*, such as by a threaded connection and a snap ring.

The locking sleeve 412 may have a shoulder 412*s* formed in an inner surface thereof and a fastener, such as a snap ring 412*f*, disposed in an outer surface thereof. The locking sleeve 412 may be movable between an unlocked position (shown) and a locked position. The locking sleeve 412 may be fastened to the body 411 in the upper position by one or more frangible fasteners, such as shear screws 411*f*. A seal 411*s* may be disposed along an outer surface of the body 411. The flapper 410*f* may be pivoted 410*p* to the body 411 and movable between an open position and a closed position (shown). The flapper 410*f* may be biased toward the closed position by a biasing member, such as a torsion spring (not shown). The flapper 410*f* may be movable to an open position in response to fluid pressure above the flapper exceeding fluid pressure below the flapper (plus resistance by the torsion spring).

If a thru-tubing operation needs to be conducted through the drill string 60, such as to remediate a well control situation, a shifting tool (not shown) may be deployed using a deployment string, such as wireline, slickline, or coiled tubing. The shifting tool may include a plug having a shoulder corresponding to the locking sleeve shoulder 412*s* and a shaft extending from the plug. The shaft may push the flapper 410*f* at least partially open as the plug seats against the locking sleeve shoulder 412*s* and, thereby equalizing pressure across the flapper. Weight of the plug may then be applied to the shoulder 410*s* by relaxing the deployment string or fluid pressure may be exerted on the plug from the surface or through the deployment string.

The shear screws 411*f* may then fracture allowing the locking sleeve 412 to be moved longitudinally relative to the body 411 until the snap ring 412*f* engages a groove 411*g* formed in an inner surface of the body. The locking sleeve 412 may engage and open the flapper 410*f* as the locking sleeve is being moved. The snap ring 412*f* may engage the groove 411*g*, thereby fastening the locking sleeve 412 in the locked position with the flapper 410*f* held open. The operation may be repeated for every RCFS 400 disposed along the drill string 60. In this manner, every RCFS 400 in the drill string 60 may be locked open in one trip. Remedial well control operations may then be conducted through the drill string in the same trip or retrieving the deployment string to surface and changing tools for a second deployment.

In operation, the RCFS 400 may be used in the drilling method, discussed above, instead of the RCFSs 100, 200. Since the float valve 410 may respond automatically, the steps of manually opening and closing the bore valve 110 are obviated. In a further alternative, the rotation stoppages of the drill string at FIGS. 5B, 5C, 5G, and 5H may be omitted by connecting the clamp 160 before engaging the slips 73 of the rotary table 70 (for 5B and 5C) and by disengaging the slips before removing the clamp (for 5G and 5H). Rotation of the drill string 60 may then be continuously maintained while adding the stand 62 to the drill string.

Figure 7B:
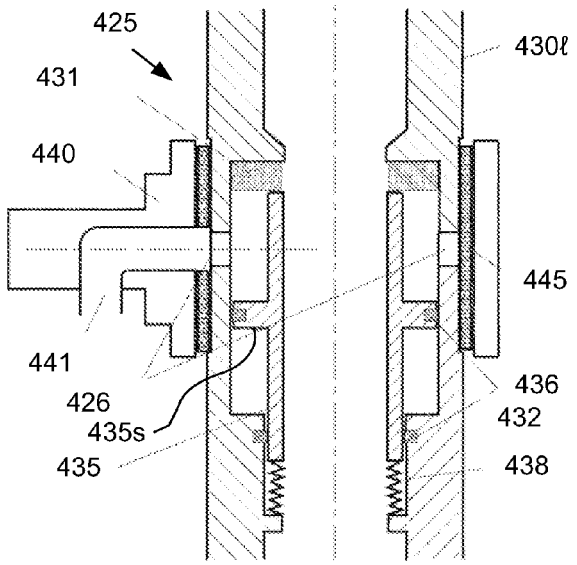
FIG. 7B is a cross-sectional view of a portion of an RCFS, according to another embodiment of the present invention.

FIG. 7B is a cross-sectional view of a portion of an RCFS 425, according to another embodiment of the present invention. The RCFS 425 may include one or more tubular housing sections 430*l* (upper housing section not shown, see 105*u*, 405*u*), a bore valve (not shown, see 110, 410), and a port valve. The lower housing section 430*l* may have one or more radial ports 426 formed through a wall thereof. The radial ports 426 may be circumferentially spaced around the lower housing section 430*l*. The RCFS 425 may be used with a modified clamp 440 equipped with a swivel, such as rotary sleeve 445 or rollers (not shown), allowing the housing 430*l* to rotate relative to the clamp. The port valve may include a sleeve 435 and a biasing member, such as a spring 438. The sleeve 435 may be disposed in a recess formed in the lower housing section 430*l*. The sleeve 435 may have a piston shoulder 435*s* having a seal 436 for engaging an inner surface of the lower housing section 430*l*. The sleeve 435 may be longitudinally movable relative to the housing 430*l* between an open position and a closed position. The spring 438 may bias the sleeve 435 toward the closed position where the sleeve isolates the housing ports 426 from the housing bore. The clamp 440 may engage the housing 430*l*. When pressure is exerted on a flow passage 441 through the clamp 440, the pressure may act on the piston shoulder 435*s* of the sleeve 435, thereby pushing the sleeve longitudinally from the closed position to the open position and allowing side circulation. When circulation through the side ports 426 is halted, the spring 438 may return the sleeve 435 to the closed position. The RCFS 425 may further include upper 431 and lower 432 seals for further isolating the ports 426 from the bore. Alignment of the clamp port 441 with the housing port 426 is not required for fluid communication of the ports.

Figure 7C:
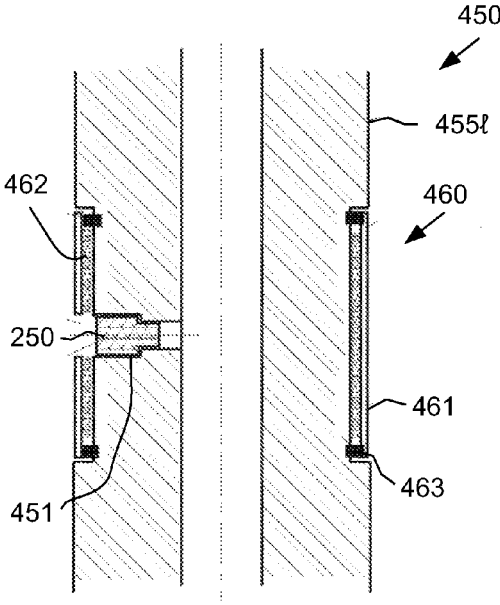
FIG. 7C is a cross-sectional view of a portion of an RCFS, according to another embodiment of the present invention.

FIG. 7C is a cross-sectional view of a portion of an RCFS 450, according to another embodiment of the present invention. The RCFS 450 may include a tubular housing 455*l* (upper housing section not shown, see 105*u*, 405*u*), a bore valve (not shown, see 110, 410), a swivel 460, and a plug 250. The lower housing section 455*l* may have a port 451 formed through a wall thereof in communication with the bore. The swivel 460 may include a sleeve 461, one or more bearings 462, and one or more seals 463. The clamp 300 may engage the rotary sleeve 461 while the housing 455*l* may rotate relative to the sleeve 461 and the clamp 300. To remove and install the plug 250, rotation of the RCFS 450 may be stopped so the clamp 300 may be aligned with the port 451 to access the plug 250.

Figure 7D:
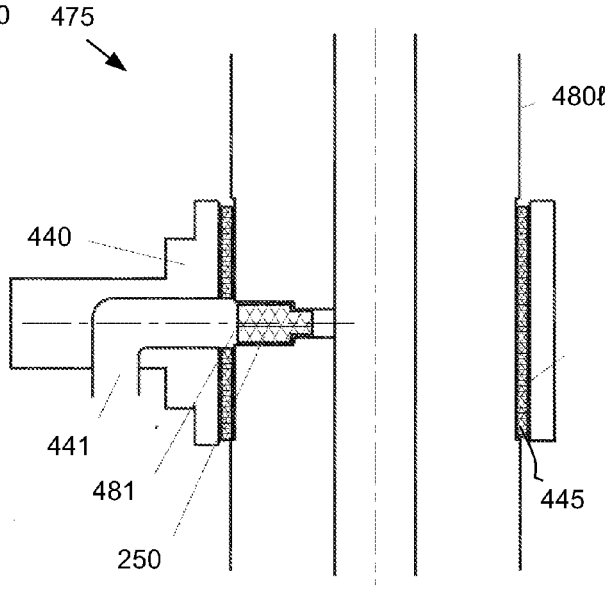
FIG. 7D is a cross-sectional view of a portion of an RCFS, according to another embodiment of the present invention.

FIG. 7D is a cross-sectional view of a portion of an RCFS 475, according to another embodiment of the present invention. The RCFS 475 may include a tubular housing 480*l* (upper housing section not shown, see 105*u*, 405*u*), a bore valve (not shown, see 110, 410), and a plug 250. The housing 480*l* may have a side port 481 and the plug may be installed and removed from the side port. As compared to the RCFS 450, the swivel has been omitted and the clamp 440 may be used with the RCFS 475 instead of the clamp 300.

Figure 8:
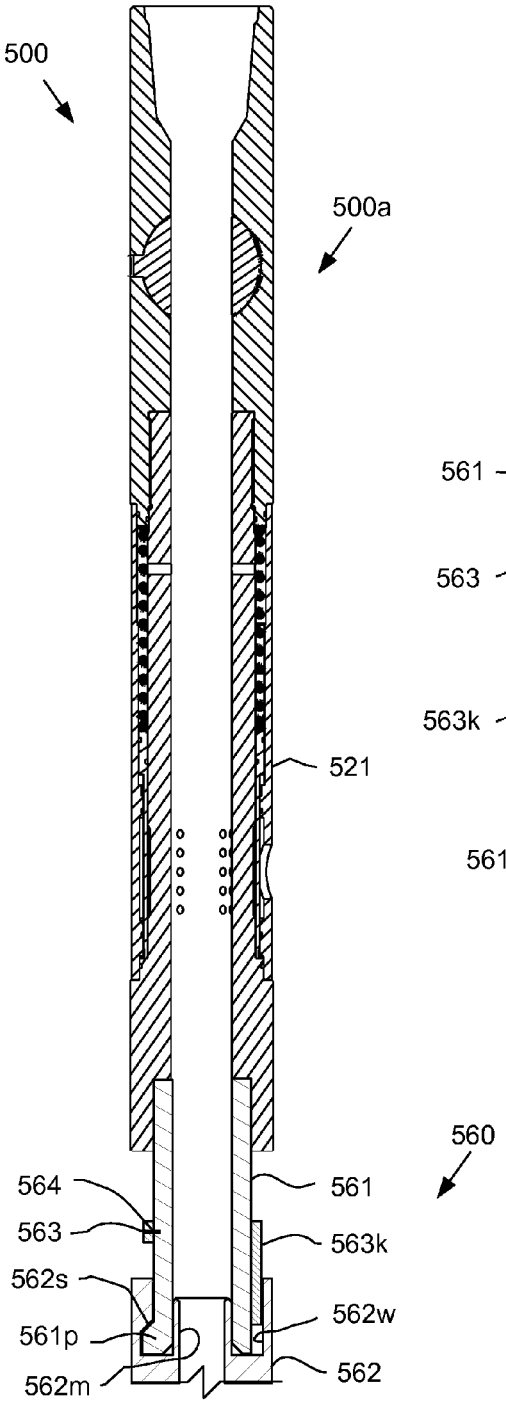
FIG. 8 is a cross-sectional view of an RCFS, according to another embodiment of the present invention.

FIG. 8 is a cross-sectional view of an RCFS 500, according to another embodiment of the present invention. The RCFS 500 may include a non-rotating CFS (NCFS) 500*a* and a locking swivel 560. The NCFS 500*a* may be similar to the RCFS 100 except that the bearings 122*u,l* may be omitted so that the sleeve 521 does not rotate relative to the housing, the seals disposed between the housing and the sleeve 521 do not have to accommodate rotation, and a bottom of the lower housing has a threaded coupling for connecting to the locking swivel 560 instead of a pin for connecting to a pup joint/drill pipe.

Figure 8A:
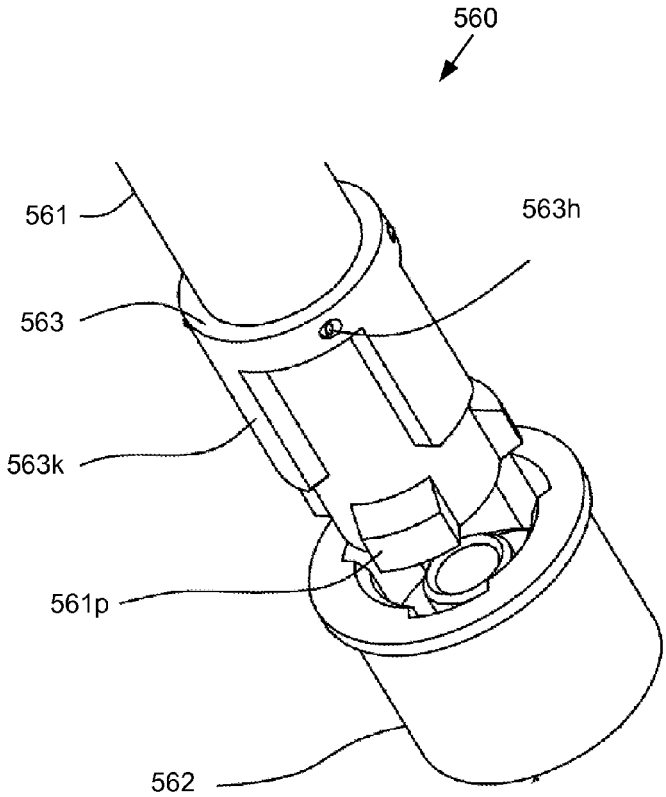
FIG. 8A is an isometric view of the locking swivel.

FIG. 8A is an isometric view of the locking swivel 560. The locking swivel 560 may include an upper housing 561 and a lower housing 562. The upper housing 561 may include one or more lugs 561*p* extending from an outer surface thereof. A lock ring 563 may be disposed around an outer the outer surface of the upper housing 561 so that the lock ring 563 is longitudinally moveable along the upper housing 561 between an unlocked position and a locked position. The lock ring 563 may include a key 563*k* for each lug 561*p*. The lower housing 562 may include a keyway 562*w* for receiving a respective lug 561*p* and a shoulder 562*s* for engaging a respective lug 561*p* once the lug 561*p* has been inserted into the keyway 562*w* and rotated relative to the lower housing until the lug 561*p* engages the shoulder 562*s*. Once each lug 561*p* has engaged the respective shoulder 562*s*, the lock ring 563 may be moved into the locked position, thereby engaging each key 563*k* with a respective keyway 562*w*. The upper housing 561 may include one or more holes laterally formed in an outer surface thereof, each hole corresponding to respective set of holes 563*h* formed through the lock ring 563. Engaging the keys 563*k* with the keyways 562*w* may align the holes for receiving a respective fastener, such as pin 564, thereby fastening the upper housing 561 to the lower housing 562. The lower housing 562 may further include a seal mandrel 562*m* extending along an inner portion thereof. The seal mandrel 562*m* may include a seal (not shown) and a bearing (not shown) disposed along an outer surface for engaging an inner surface of the upper housing 561 to seal the interface therebetween and allow relative rotation of the lower housing 562 relative to the upper housing 561.

In operation, the RCFS 500 may be used in the drilling method, discussed above, instead of the RCFS 100. The locking swivel 560 may be unlocked during the first rotation stoppage. The rotary table 70 may then rotate the drill string 60 excluding the upper housing 561 and NCFS 500*a* which may remain rotationally stationary. The locking swivel 560 may then be locked during the second rotation stoppage.

Alternatively, the NCFS 500*a* may be used in a non-rotating continuous flow drilling method (without the locking swivel and having the conventional pin coupling at a bottom of the lower housing).

FIGS. 9A-9D are cross-sectional views of wellbores 800, 810, 820, 830 being drilled with drill strings 802 employing downhole RCFSs 805, 825*a,b*, according to other embodiments of the present invention.

Figure 9A:
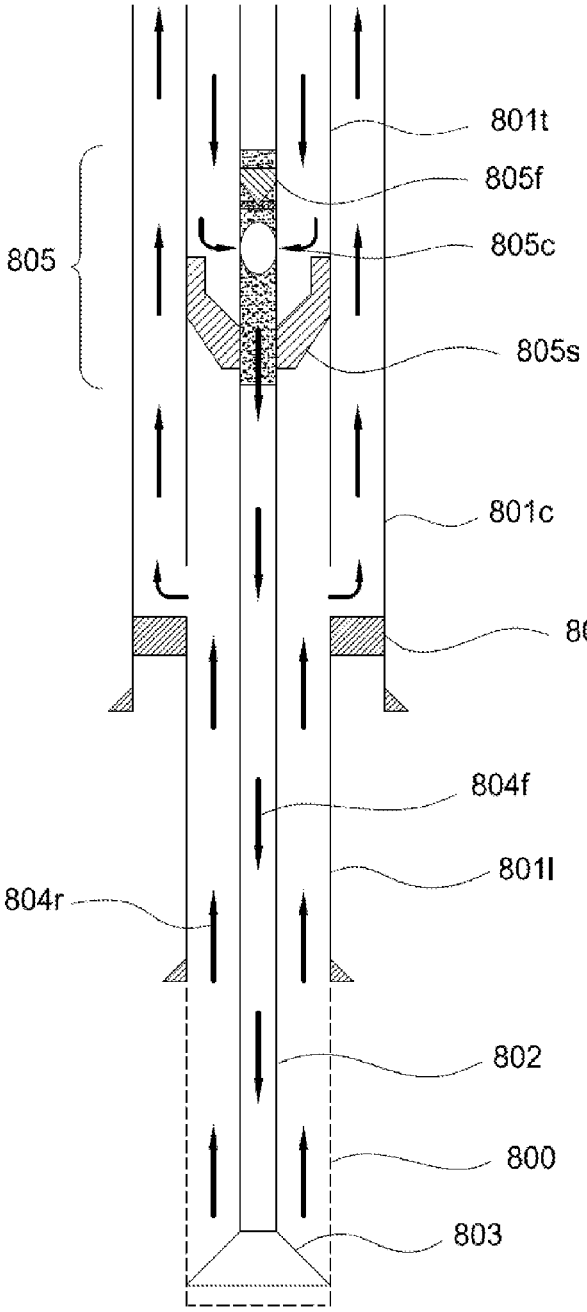
FIGS. 9A-9D are cross-sectional views of wellbores being drilled with drill strings employing downhole RCFSs, according to other embodiments of the present invention.

Referring to FIG. 9A, the wellbore 800 may have a tubular string of casing 801*c* cemented therein. A tubular liner string 801*l* may be hung from the casing 801*c* by a liner hanger 801*h*. The liner hanger may include a packer for sealing the casing-liner interface. The liner 801*l* may be cemented in the wellbore 800. A tieback casing string 801*t* may be hung from a wellhead (not shown, see FIG. 1) and may extend into the wellbore 800 proximately short of the hanger 801*h* so that a flow path is defined between the distal end of the tieback string 801*t* and the liner hanger 801*h* or top of the liner 801*l*. Alternatively, a parasite string may be used instead of the tieback string 801*t*. A drill string 802 may extend from a top drive or Kelly located at the surface (not shown, see FIG. 1). The drill string 802 may include a drill bit 803 located at a distal end thereof and a CFS 805.

The RCFS 805 may include a tubular housing have a longitudinal flow bore therethrough and a radial port through a wall thereof. A float valve 805*f* may be disposed in the housing bore and may be similar to the float valve 410. A check valve 805*c* may be disposed in the housing port. The check valve 805*c* may be operable between an open position in response to external pressure exceeding internal pressure (plus spring pressure) and a closed position in response external pressure being less than or equal to internal pressure. The check valve 805*c* may include a body, one or more seals for sealing the housing-port interface, a valve member, such as a ball, flapper, poppet, or sliding sleeve and a spring disposed between the body and the valve member for biasing the valve member toward a closed position.

The RCFS 805 may further include an annular seal 805*s*. The annular seal 805*s* may engage an outer surface of the CFS housing and an inner surface of the tie-back string 805*t* so that an upper portion of an annulus formed there-between is isolated from a lower portion thereof. The annular seal 805*s* may be longitudinally positioned below the check valve 805*c* so that the check valve is in fluid communication with the upper annulus portion. A cross-section of the annular seal may take any suitable shape, including but not limited to rectangular or directional, such as a cup-shape. The annular seal 805*s* may be configured to engage the tie-back string only when drilling fluid is injected into the tie-back/drill string annulus, such as by using the directional configuration. The annular seal may be part of a seal assembly that allows rotation of the drill string relative thereto.

The seal assembly may include the annular seal, a seal mandrel, and a seal sleeve. The seal mandrel may be tubular and may be connected to the CFS housing by a threaded connection. The seal sleeve may be longitudinally coupled to the seal mandrel by one or more bearings so that the seal sleeve may rotate relative to the seal mandrel. The annular seal may be disposed along an outer surface of the seal sleeve, may be longitudinally coupled thereto, and may be in engagement therewith. An interface between the seal mandrel and seal sleeve may be sealed with one or more of a rotating seal, such as a labyrinth, mechanical face seal, or controlled gap seal. For example, a controlled gap seal may work in conjunction with mechanical face seals isolating a lubricating oil chamber containing the bearings. A balance piston may be disposed in the oil chamber to mitigate the pressure differential across the mechanical face seals.

Additionally, the CFS port may be configured with an external connection. The external connection may be suitable for the attachment of a hose or other such fluid line. The annular seal 805*s* may also function as a stabilizer or centralizer.

The CFS 805 may be assembled as part of the drill string 802 within the wellbore 800. Once the CFS 805 is within the tie-back string 805*t*, drilling fluid 804*f* may be injected from the surface into the tieback/drill string annulus. The drilling fluid 804*f* may then be diverted by the seal 805*c* through the check valve 805*c* and into the drill string bore. The drilling fluid may then exit the drill bit 803 and carry cuttings from the bottomhole, thereby becoming returns 804*r*. The returns 804*r* may travel up the open wellbore/drill string annulus and through the liner/drill string annulus. The returns 804*r* may then be diverted into the casing/tie-back annulus by the annular seal 805*s*. The returns 804*r* may then proceed to the surface through the casing/tie-back annulus. The returns may then flow through a variable choke valve (not shown), thereby allowing control of the pressure exerted on the annulus by the returns.

Inclusion of the additional tie-back/drill string annulus obviates the need to inject drilling fluid through the top drive. Thus, joints/stands may be added/removed to/from the drill string 802 while maintaining drilling fluid injection into the tie-back/drill string annulus. Further, an additional CFS 805 is not required each time a joint/stand is added to the drill string. During drilling, drilling fluid may be injected into the top drive and/or the tie-back/drill string annulus. If drilling fluid is injected into only the top drive, the drilling fluid may be diverted to the tie-back/drill string annulus when adding/removing a joint/stand to/from the drill string. The tie-back/drill string annulus may be closed at the surface while drilling. If drilling fluid is injected into only the tie-back/drill string, injection of the drilling fluid may remain constant regardless of whether drilling or adding/removing a stand/joint is occurring.

Figure 9B:
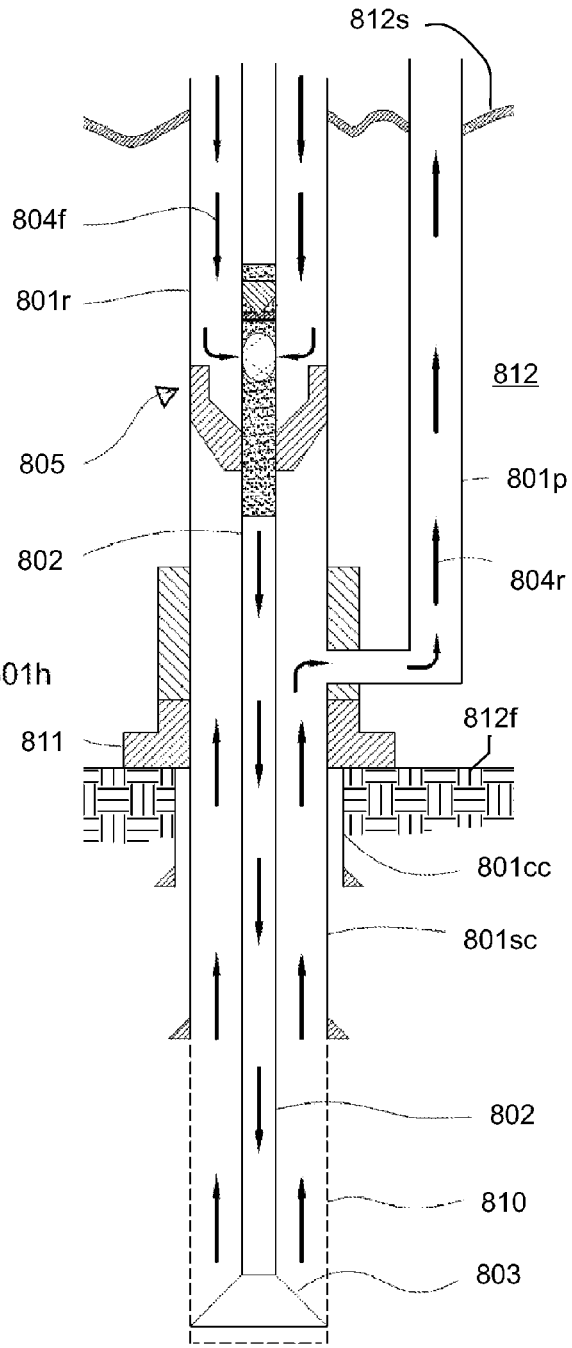

Referring to FIG. 9B, the RCFS 805 may also be deployed for drilling a wellbore 810 below a surface 812*s* of the sea 812. A tubular riser string 801*r* may connect a fixed or floating drilling rig (not shown), such as a jack-up, semi-submersible, barge, or ship, to a wellhead 811 located on the seafloor 812*f*. A conductor casing string 801*cc* may extend from the wellhead 811 and may be cemented into the wellbore. A surface casing string 801*sc* may also extend from the wellhead 811 and may be cemented into the wellbore 810. A tubular return string 801*p* may be in fluid communication with a riser/drill string annulus and extend from the wellhead 811 to the drilling rig. The riser/drill string annulus may serve a similar function to the tie-back/drill string annulus discussed above. The surface casing string/drill string annulus may serve a similar function to the liner/drill string annulus, discussed above. The returns 804*r*, instead of being diverted into the casing/tie-back annulus may be instead diverted into the return string.

Alternatively, the riser string may be concentric, thereby obviating the need for the return string 801*p*. A suitable concentric riser string is illustrated in FIGS. 3A and 3B of International Patent Application Pub. WO 2007/092956 (Atty. Dock. No. WEAT/0730-PCT, hereinafter '956 PCT), which is herein incorporated by reference in its entirety. The concentric riser string may include riser joints assembled together. Each riser joint may include an outer tubular having a longitudinal bore therethrough and an inner tubular having a longitudinal bore therethrough. The inner tubular may be mounted within the outer tubular. An annulus may be formed between the inner and outer tubulars.

Figure 9C:
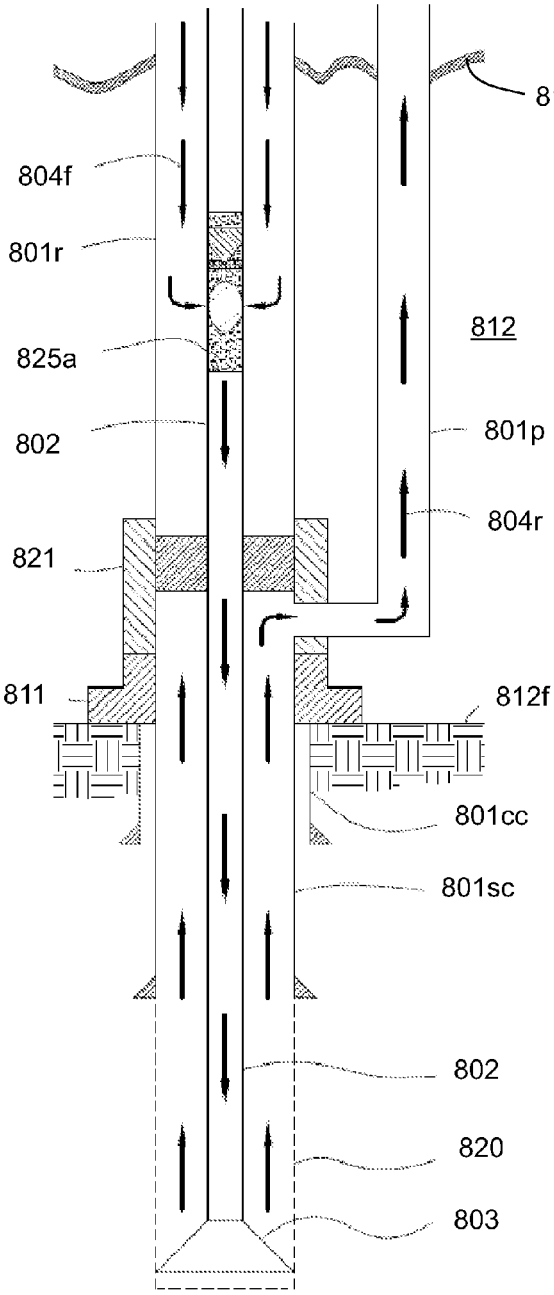

Referring to FIG. 9C, the subsea wellbore 820 may be drilled using the CFS 825*a* instead of the CFS 805. The CFS 825*a* may differ from the CFS 805 by removal of the annular seal 805*s*. Instead, a rotating control device (RCD) 821 may be used to divert the drilling fluid 904*f* into the drill string and the returns 804*r* into the returns string 801*p*. Instead of longitudinally moving with the drill string 802, the RCD 821 may be longitudinally connected to the wellhead 811.

Figure 9D:
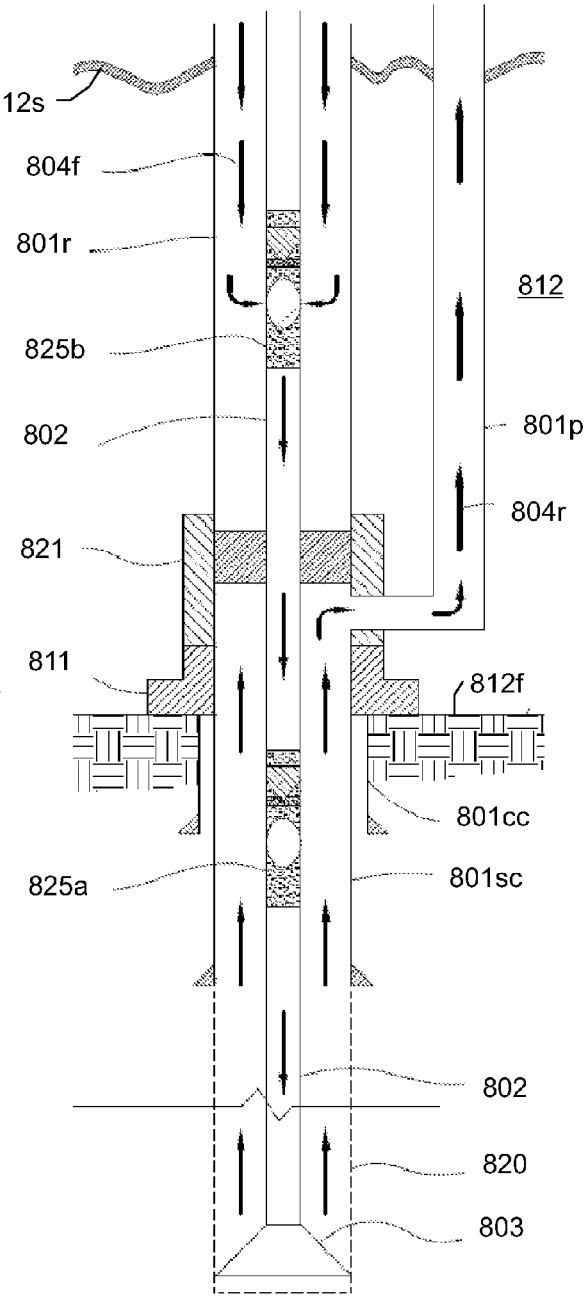

FIG. 9D illustrates the bottom of the wellbore 820 extended to a second, deeper depth relative to FIG. 9C. Once the CFS 825*a* nears the RCD 821, a second CFS 825*b* may be added to the drill string 802. The second CFS 825*b* may continue the function of the CFS 825*a*. Once drilling fluid 804*f* is diverted into the drill string 802, the drilling fluid may open the float valve 805*f* in the CFS 825*a* and close the check valve 805*c* in the CFS 825*a*. Since the CFS 825*a* may not include the annular seal 805*s*, the CFS 825*a* may pass through the RCD 821 unobstructed.

In operation, any of the downhole CFSs 805, 825*a,b* may be used in the drilling method, discussed above, instead of the RCFS 100. Use of the downhole CFSs may obviate the rotation stoppages of the drill string at FIGS. 5B, 5C, 5G, and 5H. Rotation of the drill string may then be continuously maintained while adding the stand to the drill string.

FIG. 9E is a cross-sectional view of one embodiment of the RCD 821. The RCD 821 may be located and secured within a housing 864 which includes a head 860 and a body 862. In the illustrated embodiment, the RCD 821 is removably held in place by a packing unit 868 energized by piston 866 within the housing 864. Alternatively, the RCD may be removably secured with the housing 864 using an appropriate latch, or the RCD 821 may be permanently secured within the housing 864.

The RCD 821 may further include a bearing assembly 878. The bearing assembly 878 may be attached to at least one of a top stripper rubber 882 and a bottom stripper rubber 884. The bearing assembly 878 allows stripper rubbers 882, 884 to rotate relative to the housing 864. Each rubber 882, 884 may be directional and the upper rubber 882 may be oriented to seal against the drill string 802 in response to higher pressure in the riser 801*r* than the wellbore 820 and the lower rubber 884 may be oriented to seal against the drill string in response to higher pressure in the wellbore than the riser. In operation, the drill string 802 can be received through the bearing assembly 878 so that one of the rubbers 882, 884 may engage the drill string depending on the pressure differential. The RCD 821 may provide a desired barrier or seal in the riser 801*r* both when the drill string 802 is stationary or rotating. Alternatively, an active seal RCD may be used.

While the foregoing is directed to embodiments of the present invention, other and further embodiments of the invention may be devised without departing from the basic scope thereof, and the scope thereof is determined by the claims that follow.

The invention claimed is:

1. A method for drilling a wellbore, comprising:

drilling the wellbore by advancing a tubular string longitudinally into the wellbore;

stopping drilling by holding the tubular string longitudinally stationary;

adding a tubular joint or stand of joints to the tubular string while injecting drilling fluid into a side port of the tubular string, rotating the tubular string, and holding the tubular string longitudinally stationary;

resuming drilling of the wellbore after adding the joint or stand;

opening the port before injecting drilling fluid into the port;

stopping injection of drilling fluid into the port after adding the joint or stand;

closing the port after stopping injection of drilling fluid into the port;

engaging the tubular string with a clamp before opening the port; and disengaging the clamp from the tubular string after closing the port, wherein:

the port is opened and closed by operating an electric, pneumatic, or hydraulic actuator, the actuator is part of the tubular string, and the clamp provides electrical, hydraulic, or pneumatic power to the actuator.

2. The method of claim 1, wherein the actuator opens and closes the port by longitudinally moving an internal sleeve of the tubular string to expose and cover the port.

3. A method for drilling a wellbore, comprising:

drilling the wellbore by advancing a tubular string longitudinally into the wellbore;

stopping drilling by holding the tubular string longitudinally stationary;

adding a tubular joint or stand of joints to the tubular string while injecting drilling fluid into a side port of the tubular string, rotating the tubular string, and holding the tubular string longitudinally stationary;

resuming drilling of the wellbore after adding the joint or stand;

opening the port before injecting drilling fluid into the port;

stopping injection of drilling fluid into the port after adding the joint or stand;

closing the port after stopping injection of drilling fluid into the port;

engaging the tubular string with a clamp before opening the port; and disengaging the clamp from the tubular string after closing the port, wherein the port is opened and closed by an internal sleeve of the tubular string longitudinally moving in response to injection and stoppage of injection of drilling fluid into the port to expose and cover the port.

4. A method for drilling a wellbore, comprising:

a) while injecting drilling fluid into a top of a tubular string disposed in the wellbore and having a drill bit disposed on a bottom thereof and rotating the tubular string:

drilling the wellbore by advancing the tubular string longitudinally into the wellbore; and stopping drilling by holding the tubular string longitudinally stationary;

b) injecting drilling fluid into a side port of the tubular string while injecting drilling fluid into the top, rotating the tubular string, and holding the tubular string longitudinally stationary;

c) while injecting drilling fluid into the port, rotating the tubular string, and holding the tubular string longitudinally stationary:

stopping injection of drilling fluid into the top;

adding a tubular joint or stand of joints to the tubular string; and injecting drilling fluid into the top; and d) stopping injection of drilling fluid into the port while injecting drilling fluid into the top, rotating the tubular string, and holding the tubular string longitudinally stationary.

5. The method of claim 4, further comprising:

opening the port before injecting drilling fluid into the port; and closing the port after stopping injection of drilling fluid into the port.

6. The method of claim 5, further comprising:

engaging the tubular string with a clamp before opening the port; and disengaging the clamp from the tubular string after closing the port.

7. The method of claim 6, wherein the port is opened and closed by operating an electric, pneumatic, or hydraulic actuator.

8. The method of claim 7, wherein:

the actuator is part of the tubular string, and the clamp provides electrical, hydraulic, or pneumatic power to the actuator.

9. The method of claim 8, wherein the actuator opens and closes the port by longitudinally moving an internal sleeve of the tubular string to expose and cover the port.

10. The method of claim 7, wherein:

the actuator is integral with the clamp, and the actuator opens and closes the port by removing and installing a plug from and into the port.

11. The method of claim 10, wherein:

the tubular string comprises a swivel, and the port is formed through a wall of the swivel.

12. The method of claim 10, wherein the port is formed through a wall of a joint of the tubular string.

13. The method of claim 12, wherein:

the tubular string comprises a swivel, and the clamp engages the swivel.

14. The method of claim 12, wherein:

the clamp comprises a swivel, and the swivel engages the tubular string.

15. The method of claim 6, wherein the port is opened and closed by an internal sleeve of the tubular string longitudinally moving in response to injection and stoppage of injection of drilling fluid into the port to expose and cover the port.

16. The method of claim 4, wherein:

drilling is further stopped by substantially reducing an angular velocity of the drill string, and rotation of the tubular string adding the joint or stand is at the substantially reduced angular velocity.

17. The method of claim 4, wherein:

the wellbore is drilled using a top drive, and the tubular string is rotated while adding the joint or stand using a rotary table.

18. The method of claim 4, further comprising:

closing a portion of a bore of the tubular string between the port and a top of the tubular string before adding the joint or stand; and opening the bore portion after adding the joint or stand.

19. The method of claim 4, wherein a float valve of the tubular string closes a portion of a bore of the tubular string during adding of the joint or stand.

20. The method of claim 4, further comprising stopping rotation of the tubular string before adding the joint or stand.

21. The method of claim 4, wherein rotation of the tubular string is continuously maintained during the method.

22. The method of claim 4, wherein the port is located downhole or subsea while the joint or stand is added.

* * * * *